US012778182B1

(12) United States Patent
Dale et al.

(10) Patent No.: US 12,778,182 B1
(45) Date of Patent: Nov. 3, 2026

(54) HEMP SNUFF

(71) Applicants: Robert Dale, Culver, OR (US); Lifen Huang So, Culver, OR (US); Timothy Riddle, Appleton, WI (US)

(72) Inventors: Robert Dale, Culver, OR (US); Lifen Huang So, Culver, OR (US); Timothy Riddle, Appleton, WI (US)

( * ) Notice: Subject to any disclaimer, the term of this patent is extended or adjusted under 35 U.S.C. 154(b) by 0 days.

(21) Appl. No.: 19/219,203

(22) Filed: May 27, 2025

Related U.S. Application Data

(63) Continuation-in-part of application No. 18/132,303, filed on Apr. 7, 2023, now abandoned.

(60) Provisional application No. 63/328,617, filed on Apr. 7, 2022.

(51) Int. Cl.

| | |
|---|---|
| ***A24B 13/00*** | (2006.01) |
| ***A24B 15/16*** | (2020.01) |
| ***A24B 15/28*** | (2006.01) |
| ***A24B 15/30*** | (2006.01) |
| ***A24B 15/32*** | (2006.01) |
| ***A24B 15/34*** | (2006.01) |
| ***A24B 15/40*** | (2006.01) |
| ***A24B 15/42*** | (2006.01) |

(52) U.S. Cl.
CPC ..... *A24B 15/16* (2013.01); *A24B 13/00* (2013.01); *A24B 15/283* (2013.01); *A24B 15/301* (2013.01); *A24B 15/303* (2013.01); *A24B 15/32* (2013.01); *A24B 15/34* (2013.01); *A24B 15/345* (2013.01); *A24B 15/403* (2013.01); *A24B 15/406* (2013.01); *A24B 15/42* (2013.01)

(58) Field of Classification Search
CPC ..... A24B 15/16; A24B 13/00
See application file for complete search history.

(56) References Cited

U.S. PATENT DOCUMENTS

| | | | | |
|---|---|---|---|---|
| 2007/0062549 | A1* | 3/2007 | Holton, Jr. ..... | A24B 15/28 131/352 |
| 2009/0095313 | A1* | 4/2009 | Fuisz ..... | A24B 15/186 131/290 |
| 2009/0301505 | A1* | 12/2009 | Liu ..... | A24B 13/00 131/309 |
| 2010/0126520 | A1* | 5/2010 | Clayton ..... | A24B 13/00 131/277 |
| 2019/0037909 | A1* | 2/2019 | Greenbaum ..... | A24B 15/303 |
| 2020/0316015 | A1* | 10/2020 | Green ..... | A61K 31/015 |

* cited by examiner

*Primary Examiner* — Philip Y Louie
*Assistant Examiner* — Yana B Krinker
(74) *Attorney, Agent, or Firm* — Intellectual Property Consulting, LLC; Mark N. Melasky; Jared Rovira

(57) ABSTRACT

In accordance with embodiments of the invention, a snuff is provided. The snuff includes a hemp biomass. The hemp biomass may be combined with water. The snuff includes a binder operable to bind to the water. The snuff includes sodium and a mold inhibitor. The snuff includes a terpene compound selected from a group of terpenes to produce a desired smell and flavor. In one embodiment, the terpene compound includes myrcene, humulene, α-Pinene, and β-caryophyllene. The snuff may further include a flavoring compound.

4 Claims, No Drawings

HEMP SNUFF

CROSS-REFERENCE TO RELATED APPLICATIONS FIELD OF THE INVENTION

This application is a continuation in part application of U.S. patent application Ser. No. 18/132,303, filed Apr. 7, 2023, which claims priority to U.S. Provisional Patent Application Ser. No. 63/328,617, filed Apr. 7, 2022, and the entireties of are each incorporated by reference as if fully disclosed herein.

BACKGROUND OF THE INVENTION

I. Filed of the Invention

The present invention relates generally to hemp-based snuff products for oral consumption.

II. General Background

Smokeless tobacco products, such as chew or snuff, are tobacco-based products that are held in the mouth for an extended period by which the ability of mastication either chewed or used as snuff ("dipped"). The mastication of chewing tobacco or snuff is the act or process of chewing of a substance in which the substance is chewed and mixed with saliva, and which may or may not form a bolus for swallowing. Chewing tobacco, which is popularly called chew or chaw, is available as coherent plugs. On the other hand, snuff may indicate a partial act of being held between the cheek and gum. Snuff is available in two forms—dry for sniffing and moist (or wet) for holding between the cheek, lips, and gums.

The practice of using moist snuff is popularly called dipping. Snuff traditionally, is typically made from ground or pulverized tobacco leaves containing the highly addictive and harmful neuro-toxic nitrogenous nicotine and activates the adrenal glands, stimulating epinephrine, and also releases dopamine. Many users of snuff also enjoy the flavor and the aromatic sensation of the in their mouths, which is colloquially referred to as "bite." The nicotine in tobacco is a substance to which people may become addicted through its effects on adrenal glands, epinephrine, and dopamine pathway in the brain. In addition, diseases, such as cancer of the mouth, may be caused by chewing or holding tobacco in the mouth, or gastrointestinal when saliva combined with tobacco is ingested cancer. Thus, increasing attention by the medical profession and the public has been aimed at and campaigned against chewing tobacco and moist snuff due to its harmful constituents contained within tobacco. In light of the foregoing, there is a need for non-tobacco products intended for personal use, as moist chew or snuff which provides an optimistic opportunity to replicate the sensation in typical smokeless tobacco product and/or products. Such smokeless non-tobacco products may be offered as a healthier alternative to smokeless tobacco products, especially for those who currently use smokeless tobacco products.

SUMMARY OF THE INVENTION

In accordance with embodiments of the invention, a snuff is provided. The snuff includes a hemp biomass. The hemp biomass may be combined with water. The snuff includes a binder operable to bind to the water. The snuff includes sodium and a mold inhibitor. The snuff includes a terpene compound selected from a group of terpenes to produce a desired smell and flavor. In one embodiment, the terpene compound includes myrcene, humulene, α-Pinene, and β-caryophyllene. The snuff may further include a flavoring compound.

DETAILED DESCRIPTION

It will be readily understood that the components, as generally described herein, could be arranged and designed in a wide variety of different configurations or be entirely separate. Thus, the following more detailed description of the embodiments of the system and method of the disclosure is not intended to limit the scope of the disclosure, as claimed, but is merely representative of possible embodiments of the disclosure.

In accordance with embodiments of the invention, a hemp snuff for oral consumption is provided. In accordance with embodiments of the invention, a snuff is provided. The snuff includes a hemp biomass. The hemp biomass may be made from the leaves of the hemp plant, for example. In applications utilizing hemp biomass, stalks, seeds, and stems may be separated from the hemp plant, by mechanical means for example, resulting only in the remaining leaves for use in manufacturing the snuff. This is advantageous for the mouth feel for the user, as stalks, seeds, and stems may be uncomfortable on the inside of the mouth of a user. While the hemp plant is described in the exemplary embodiments, one skilled in the art will appreciate that alternative plants or sources of biomass may be used for the snuff. As will be explained in more detail below, the hemp biomass is dried (to below 10% water content, for example), screened to 1/16 in particle size, and steam distilled to remove the essential oils and cannabinoids from the hemp biomass. Other methods of removing the essential oils and reducing the particle size of the hemp biomass may be utilized depending on the application. The hemp biomass may be combined with water to emulate the moisture of a wet snuff. Another fluid may be utilized depending on the application. The snuff includes a binder operable to bind to the water. The binder may be a natural fiber or cellulose, such as bamboo fiber, cotton, or corn, for example. The binder serves to absorb some of the water to replicate the mouth feel of a tobacco product. In some embodiments, the ratio of water to hemp biomass is four to one, for example. The snuff includes sodium (NaCl). The sodium as a whole produces saliva and the chlorine component intensifies the flavor profile. The snuff further includes a mold inhibitor. The mold inhibitor may be an enzyme based mold inhibitor, for example.

The snuff includes a terpene compound selected from a group of terpenes to produce a desired smell and flavor. In one embodiment, the terpene compound includes myrcene, humulene, α-Pinene, and β-caryophyllene, for example. Myrcene has an earthy, fruity, clove-like, and pungent aroma. Humulene has a hoppy aroma. α-Pinene has a spicy, woody, and pine aroma. β-caryophyllene has a spicy and peppery odor. Together, the exemplary terpene compound emulates the smell and flavor of tobacco, although other terpene combinations may be suitable to achieve emulations of the smell and taste of tobacco. As such, when a user experiences the same smell and flavor of tobacco, their mind may react the same way if using a tobacco product. Thus, the snuff may be a suitable replacement and/or product to aid in the reduction or elimination of use of a tobacco product. Other terpenes may be used to produce different flavors or smells or activate different senses as desired. The snuff may further include a flavoring compound, which may include one or more essential oils to alter the flavor profile. As oils and water do not mix, in some embodiments, the flavoring compound may further include an emulsifier to maintain consistency of the snuff and aid with mouth feel, rather than a separation of an oil and water mixture. The resulting snuff is a non-tobacco product, which contains no nicotine, THC, or cannabinoids. The snuff provides a healthy alternative to traditional chewing tobacco or snuff, providing a moist non-addictive, non-toxic alternative to harmful tobacco and its injurious constituents.

In an exemplary formulation and method of manufacture, the hemp snuff is made from hemp biomass, ranging from 22.2 percent to 68.0 percent by weight of cut hemp plant, leaf, stem, seed and or stalk, a natural fiber and/or cellulose source of weights ranging from 0.01 micrograms to 22.0 grams, and between 8 and 54.5 percent (%) water. Flavoring compound may range from 0.01% to 4.8% by weight, for example. In one embodiment, natural bamboo fiber is included ranging from 0.1% to 5.2% by weight to modify the texture and to bind free radical water thus controlling water activity. In one embodiment, the hemp snuff comprises 50 percent hemp biomass by weight and 5 to 10 percent flavoring compound by weight. The dried hemp biomass is processed by mechanical means (e.g., seeds stems, leaves, and stalk stripped from the hemp plant), dried to below and in between 2% and 10% moisture content, and screened to about 1/16 inch minus. The dried hemp biomass is steam distilled to remove the essential oils of the biomass of the hemp.

The utilization of the hemp biomass, containing the hemp leaves, seeds, and/or stems, is advantageous to achieve a texture comparable to traditional tobacco snuff. Drying the hemp biomass to less than 10% moisture content, for example, is advantageous for storage and permeability. Storing the dried hemp biomass mitigates mycotoxins production from certain molds until the material can be steamed. In addition, steamed hemp biomass allows the use of a liquid plant-based flavoring compound, such as terpenes as flavonoids, to absorb into the dried hemp biomass rather than simply coating the dried hemp biomass.

In accordance with embodiments of the invention, a method of producing the hemp snuff is provided. The method includes a first step of selectively screening (sizing) of the seed, stalk and stems of the hemp biomass from a hemp plant. The method includes a second step of drying the hemp biomass to below 10% moisture content. The method includes a third step of screening the dried hemp biomass on screens to about 1/16 inch minus (i.e., no particle exceeds 1/16 inch in size), as illustrated. In one embodiment the dried hemp biomass is screed to between about 1/16 inch minus and about 1/32 inch minus. The third step separates any remining stems, stalks, seeds, and flower contained within the dried hemp biomass because the stems, stalks, seeds, and flower are not desirable for the consistency of the hemp biomass and can provide discomfort to a user when in the user's mouth by prickling or poking the inside of the user's mouth. Stems, stalks, seeds, and flowers can also clog the machinery. The method includes a fourth step of separation methodology of the hemp biomass into a vessel operable for use in a steam distiller. The method includes a fifth step of lowering the container containing the hemp biomass into the steam distiller. The method includes a sixth step of steam distilling the dried hemp biomass to remove compounds from the hemp biomass, such as terpenes, fats, waxes, lipids, essential oils and cannabinoids, except proteins and sugars, for example. The sixth step may steam distill the hemp biomass from one hour to four hours, for example. In one embodiment, a cauldron of the steam distiller is kept as close to 200 degrees Fahrenheit as possible during the steam distilling sixth step. An upper column of the steam distiller is kept as close to 200 degrees Fahrenheit as possible, ranging from 190 degrees Fahrenheit to 215 degrees Fahrenheit, depending on pressure, during the steam distilling sixth step. A lower column of the steam distiller is kept as close to 80 degrees Fahrenheit as possible during the steam distilling sixth step. The method includes a seventh step of adding the flavoring compound to the hemp biomass to modify the flavor and consistency of the hemp biomass to form the hemp snuff. In some embodiments, the flavoring compound includes added ethanol to increase viscosity. The essential oils of the flavoring compound are water soluble through an emulsification process. The flavoring compound may be atomized and sprayed over the dried hemp biomass, for example. The method includes an optional eighth step of sitting in a tub or tubs (depending on quantity) for 24 hours.

Removing the cannabinoids (THC, CBD, etc.) in the form of essential oils from the dried hemp biomass in the sixth step enables compliance in commerce across state lines. Regarding steam distillation and removal of cannabinoids from hemp, see *Terpenes and Cannabinoids Yields and Profile from Direct-Seeded and Transplanted CBD-Cannabis sativa* by Valtcho D. Zheljazkov, Jay S. Noller, Filippo Maggi, and Robert Dale, Journal of Agricultural and Food Chemistry 2022 70 (34), 10417-10428, DOI: 10.1021/acs.jafc.1c06912, the entirety of which is incorporated by reference as if fully disclosed herein. Using steam distillation in the sixth step is preferable, as alternatives such as using ethanol or hydrocarbons as solvent does not remove all of the oils from the dried hemp biomass. Steam removes other undesirables such mycotoxins (fungi), fats, waxes, lipids, terpenes, and all essential oils. Steam also renders the hemp biomass in a state that allows the flavor compound, which includes essential oils, added in the sixth step to soak into the dried hemp biomass as opposed to only coating the dried hemp biomass, as steam distilling leaves the hemp biomass in a state that is sterilized and with a cell wall that will accept flavor from the addition of essential oils. One advantage of using steam distilling in the process is that the hemp biomass will not mold in the container. The steam distilling process sterilizes the hemp biomass to eliminate bacterial and fungal properties and breaks down the cell wall of the hemp biomass. The cellular breakdown takes the hemp leaf from a sharp, crunchy type of texture to a soft, pliable texture. Unless the hemp leaf is steam distilled, the texture of the snuff will not properly emulate that of a traditional tobacco snuff. Utilizing alcohol or hydrocarbons to remove the essential oils does not give the hemp biomass the same texture. The end result of the method is a shelf stable product made from plants and plant extracts.

Hemp used in the snuff may be a sustainable hemp species (varietal), including fermented or unfermented hemp. The hemp used in the snuff may be field cured, controlled environment cured, burly, air dried, fluid bed dried, or flue dried. The hemp used in the snuff may be whole leaf, stems, seeds, or stalks.

Alternative varieties of chosen species and variations thereof may include the use of hemp leaf, hemp stems, hemp seeds and or hemp stalks to assist in the desired appearance for the finished snuff. In addition, the steam distilled biomass size particles may be commingled with selected homogenized hemp plant constituents, such as stalks, seeds, and leaf, and essential oils from said plant and biomass for the purpose of controlling texture, flavor and aromatic influence during mastication.

The present invention and formulations of the snuff may include biomass, terpene oils, essential oils, and the mixtures of said hemp particulates, i.e., hemp plant, hemp leaf and hemp seed, and hemp stalk, which are suited for foods, beverages, pharmaceuticals, and nutraceutical applications. Also provided are methods for the for the manufacturing, process, science, and technologies.

In one embodiment, the snuff is a chewable product obtained from the hemp plant and or hemp by-products including the inner cellulosic from the hemp plant and or the inner fibers, flavonoids, and aromatic molecules of the essential oil compounds within. The snuff includes flavonoids, aromatics, and constituents which are contained within, the addition of said to be inclusive and contained within the natural specific health attributes and benefits through mastication.

The snuff provides an opportunity for a healthier alternative to tobacco and tobacco's corresponding neuro toxic and additive effects, including the elimination of nicotine. Nicotine is a naturally occurring alkaloid and a sympathomimetic drug. The use of tobacco and tobacco related products are significant contributors related to numerous injurious health issues.

Embodiments of the snuff include the terpenes of the hemp extracted essential oils and a mixture of terpenes, terpene oils hemp biomass, acids and acidulants, emulsifiers and surfactants that are applicable for food, foodstuffs, pharmaceutical nutraceuticals, distilled spirits, and beverages.

Therapeutic influence of the hemp terpenes and effects are associated with the snuff. Terpenes medicinal properties are both supported by the sciences and referenced medicinal benefits and their constituents contained within, in which demonstrate the following attributes: anti-inflammatory, antioxidant, analgesic, anticonvulsive, anticancer, anxiolytic, antitumor and anti-mutagenic and continued research of additional molecules associated with health benefits of terpenes which are present in the snuff.

One of the major attributes in the snuff it that it contains a non-nicotine position and nicotine itself as it relates to its addictiveness and toxicities. The neuroscience and research identifies nicotine's psychoactive components, but its effects in which the neuroreceptors are identified and the relationship between the brain and gut are understood to have implementations on the gut microflora. Nicotine primarily exerts its effects by the activation and its influence as an agonist and stated relationship wherein specific receptors and of the neurotransmitters, i.e. acetylcholine. These receptors also known as neutronic acetylcholine receptors. These neutronic acetylcholine receptors are found throughout the central and peripheral nervous system.

When individuals cleanse the body of nicotine it has been identified to possibly cause a disruption of gut microflora, acetylcholine, and further disruption of gut microbes. The mechanism is well understood, when nicotine binds to nicotinic acetylcholine receptors, which typically causes depolarization of the neurons. They are identified on acetylcholine receptors and their influence on various neurotransmitters.

The nicotine activity at the acetylcholine receptor sites is thought to be the conjecture for the drugs interactive effects, i.e., addictiveness and toxicities which are identified as caused by a major increase in dopamine levels.

The pathway and causes depict the increased release of catecholamines related epinephrine from the adrenal glands which further enhance the sympathetic activity. The increase in sympathetic activities highly influences the body's systemic system and the gut, its microflora, microbes, and permeability, thus leading to gut microflora imbalance and its constituents of SCFA (short chain fatty acid) producing bacteria.

Snuff users enjoy the sensation or bite of the product as it contacts the interior of their mouths between their lips and gums. To achieve this sensation, the flavoring compound 104 includes one or more essential oils or terpenes as indicated below.

Exemplary Formulation 1 of the snuff: 500 grams steam distilled bio-mass which pass through a ¼ mm mesh stainless screen; cotton fiber 0.021 grams to 8.76 grams; water 1.44 to 23.55 grams; sodium 0.013 grams to 16.44 grams; mold inhibitor, such as an enzyme based mold inhibitor (e.g., a plant based preservative), 0.01 grams to 5.87 grams; sunflower lecithin 0.01 grams to 4.88 grams; ginger 0.001 grams to 2.77 grams; malic acid or citric acid 0.11 grams to 3.01 grams; myrcene 0.001 grams to 0.44 grams; humulene 0.001 grams to 0.88 grams; alpha pinene 0.0124 grams to 2.98 grams; beta pinene 0.001 grams to 0.66 grams; and caryophyllene 0.0088 grams to 0.53 grams.

Exemplary Formulation 2 of the snuff: 500 grams steam distilled bio-mass which pass through a ¼ mm mesh stainless screen; cellulose fiber 0.113 grams; water 1.111 grams to 211 grams; sodium 1.03 grams to 14.33 grams; mold inhibitor 0.12 grams to 0.77 grams; data esters (emulsifier surfactant) 0.01 grams to 6.64 grams; licorice 0.11 grams to 1.77 grams; caffeine 0.01 grams to 1.99 grams; ascorbic acid 0.11 grams to 0.77 grams; myrcene 0.001 grams to 0.51 grams; humulene 0.0125 grams to 0.77 grams; alpha pinene 0.01 grams to 0.127 grams; and caryophyllene 0.001 grams to 0.66 grams.

Exemplary Formulation 3 of the snuff: 500 grams steam distilled bio-mass which pass through a ¼ mm mesh stainless screen; bamboo fiber 0.1 grams to 0.88 grams; water 21 grams to 17.0 grams; salt 3.33 grams to 13.4 grams; mold inhibitor 0.11 grams to 0.77 grams; sucrose esters 0.11 grams to 0.33 grams; agave syrup 0.11 grams to 0.93 grams; caffeine 0.005 grams to 0.21 grams, citric acid 0.01 grams to 0.66 grams; cuparene 0.0125 to 0.884 grams; farnesol 0.11 grams to 0.67 grams; cis-nerolidol 0.0125 to 0.88 grams; and myrcene 0.0131 grams to 0.100 grams.

Exemplary Formulation 4 of the snuff: 500 grams steam distilled biomass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.10 grams to 1.72 grams; molasses 0.10 grams to 1.44 grams; ginger 0.05 grams to 0.88 grams; malic acid 0.022 grams to 0.77 grams; citric acid 0.002 grams to 0.77 grams; myrcene 0.01 grams to 1.6 grams; humulene 0.0125 grams to 1.3 grams; caryophyllene 0.01 grams to 1.25 grams; alpha pinene 0.0122 grams to 1.7 grams; and beta pinene 0.01 grams to 1.47 grams.

Exemplary Formulation 5 of the snuff: 500 grams steam distilled bio-mass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.1.0 grams to 1.72 grams; molasses 0.10 grams to 1.44 grams; ginger 0.05 grams to 0.88 grams; malic acid 0.022 grams to 0.77 grams; citric acid 0.002 grams to 0.77 grams; myrcene 0.01 grams to 1.6 grams; humulene 0.0125 grams to 1.3 grams; caryophyllene 0.01 grams to 1.25 grams; alpha pinene 0.0122 grams to 1.7 grams; beta pinene 0.01 grams to 1.47 grams; beef extract 0.11 grams to 8.7 grams; and maltodextrin 0.1 grams to 2.22 grams.

Exemplary Formulation 6 of the snuff: 500 grams steam distilled bio-mass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.1.0 grams to 1.72 grams; molasses 0.10 grams to 1.44 grams; ginger 0.05 grams to 0.88 grams; malic acid 0.022 grams to 0.77 grams; citric acid 0.002 grams to 0.77 grams; myrcene 0.01 grams to 1.6 grams; humulene 0.0125 grams to 1.3 grams; caryophyllene 0.01 grams to 1.25 grams; alpha pinene 0.0122 grams to 1.7 grams; beta pinene 0.01 grams to 1.47 grams; strawberry extract 0.11 grams to 8.7 grams; and almond oil 0.1 grams to 2.22 grams.

Exemplary Formulation 7 of the snuff: 500 grams steam distilled bio-mass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.1.0 grams to 1.72 grams; molasses 0.10 grams to 1.44 grams; ginger 0.05 grams to 0.88 grams; malic acid 0.022 grams to 0.77 grams; citric acid 0.002 grams to 0.77 grams; myrcene 0.01 grams to 1.6 grams; humulene 0.0125 grams to 1.3 grams; caryophyllene 0.01 grams to 1.25 grams; alpha pinene 0.0122 grams to 1.7 grams; beta pinene 0.01 grams to 1.47 grams cocoa extract; 0.11 grams to 8.7 grams; and menthe extract 0.1 grams to 2.22 grams.

Exemplary Formulation 8 of the snuff: 500 grams steam distilled bio-mass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.10 grams to 1.72 grams; molasses 0.10 grams to 1.44 grams; ginger 0.05 grams to 0.88 grams; malic acid 0.022 grams to 0.77 grams; citric acid 0.002 grams to 0.77 grams; myrcene 0.01 grams to 1.6 grams; humulene 0.0125 grams to 1.3 grams; caryophyllene 0.01 grams to 1.25 grams; alpha pinene 0.0122 grams to 1.7 grams; beta pinene 0.01 grams to 1.47 grams; sesame oil 0.11 grams to 8.7 grams; ginger extract 0.17 grams to 3.11 grams; onion 0.1 grams to 2.22 grams; and garlic 0.10 grams to 2.33 grams.

Exemplary Formulation 9 of the snuff: 500 grams steam distilled bio-mass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.10 grams to 1.72 grams; molasses 0.10 grams to 1.44 grams; ginger 0.05 grams to 0.88 grams; malic acid 0.022 grams to 0.77 grams; citric acid 0.002 grams to 0.77 grams; myrcene 0.01 grams to 1.6 grams; humulene 0.0125 grams to 1.3 grams; caryophyllene 0.01 grams to 1.25 grams; alpha pinene 0.0122 grams to 1.7 grams; beta pinene 0.01 grams to 1.47 grams; mesquite 0.11 grams to 8.7 grams; soy sauce 0.17 grams to 3.11 grams; garlic 0.033 to 0.66 grams; smoke flavors 0.104 grams to 2.66 grams; dextrose 0.44 grams to 3.12 grams; and turmeric 0.21 grams to 3.33 grams.

Exemplary Formulation 10 of the snuff: 500 grams steam distilled bio-mass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.1.0 grams to 1.72 grams; molasses 0.10 grams to 1.44 grams; ginger 0.05 grams to 0.88 grams; malic acid 0.022 grams to 0.77 grams; citric acid 0.002 grams to 0.77 grams, myrcene 0.01 grams to 1.6 grams; humulene 0.0125 grams to 1.3 grams; caryophyllene 0.01 grams to 1.25 grams; alpha pinene 0.0122 grams to 1.7 grams; beta pinene 0.01 grams to 1.47 grams; soy sauce solids 0.11 grams to 8.7 grams; red pepper 0.17 grams to 3.11 grams; vinegar 0.033 to 0.66 grams; paprika oil 0.104 grams to 2.66 grams; corn syrup solids 0.22 grams to 2.12 grams; and turmeric 0.21 grams to 1.33 grams Exemplary Formulation 11 of the snuff: 500 grams steam distilled bio-mass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.10 grams to 1.72 grams; molasses 0.10 grams to 1.44 grams; ginger 0.05 grams to 0.88 grams; malic acid 0.022 grams to 0.77 grams; citric acid 0.002 grams to 0.77 grams; myrcene 0.01 grams to 1.6 grams; humulene 0.0125 grams to 1.3 grams; caryophyllene 0.01 grams to 1.25 grams; alpha pinene 0.0122 grams to 1.7 grams; linalool 0.01 grams to 1.47 grams; D-limonene 0.11 grams to 8.7 grams; beta caryophyllene 0.17 grams to 3.11 grams; alpha caryophyllener 0.033 to 0.66 grams; and valencene 0.104 grams to 2.66 grams.

Exemplary Formulation 12 of the snuff: 500 grams steam distilled bio-mass which pass through a ¼ mm mesh stainless screen; bamboo fiber 0.001 grams to 5.1 grams; water 5.0 grams to 16.4 grams; sodium 1.3 grams to 11.88 grams; mold inhibitor 0.01 grams to 1.4 grams; soy lecithin 0.1.0 grams to 1.72 grams; molasses 0.10 grams to 1.44 grams; ginger 0.05 grams to 0.88 grams; malic acid 0.022 grams to 0.77 grams; citric acid 0.002 grams to 0.77 grams; myrcene 0.01 grams to 1.6 grams; humulene 0.0125 grams to 1.3 grams; caryophyllene 0.01 grams to 1.25 grams; alpha pinene 0.0122 grams to 1.7 grams; linalool 0.01 grams to 1.47 grams; picrocrocin 0.11 grams to 8.7 grams; beta caryophyllene 0.17 grams to 3.11 grams; alpha caryophyllene 0.033 to 0.66 grams; valencene 0.104 grams to 2.66 grams; and safrene 0.1 grams.

Exemplary Formulation 13 of the snuff: 470.0 grams to 496.0 grams steam distilled biomass that pass through a 1/16 stainless steel screen (mesh), 218.0 grams to 247.8 grams water, bamboo fiber 0.01 grams to 5.67 grams, myrcene 0.01 grams to 0.44 grams, humulene 0.001 grams to 0.88 grams, α-Pinene 0.124 grams to 0.66 grams, β-caryophyllene 0.088 grams to 0.53 grams, mold inhibitor 0.11 grams to 0.93 grams, sodium 1.3 grams to 11.88 grams, beef extract 0.013 grams to 1.755 grams, and emulsifier (polysorbate 80) 0.003 grams to 0.665 grams.

Exemplary Formulation 14 of the snuff: 483.0 grams to 488.0 grams steam distilled biomass that pass through a 1/16 stainless steel screen (mesh), 218.0 grams to 247.8 grams water, bamboo fiber 0.01 grams to 5.67 grams, myrcene 0.01 grams to 0.44 grams, humulene 0.001 grams to 0.88 grams, α-Pinene 0.124 grams to 0.66 grams, β-caryophyllene 0.088 grams to 0.53 grams, mold inhibitor 0.11 grams to 0.93 grams, sodium 1.3 grams to 11.88 grams, chocolate liquor 0.55 grams to 10.61 grams, lemongrass oil 0.001 grams to 3.11 grams, emulsifier (polysorbate 60) 0.001 grams to 2.66 grams, and mono-diglyceride 0.001 grams to 2.0 grams.

Exemplary Formulation 15 of the snuff: 494.0 grams to 514.0 grams steam distilled biomass that pass through a 1/16 stainless steel screen (mesh), 218.0 grams to 247.8 grams water, bamboo fiber 0.01 grams to 5.67 grams, myrcene 0.01 grams to 0.44 grams, humulene 0.001 grams to 0.88 grams, α-Pinene 0.124 grams to 0.66 grams, β-caryophyllene 0.088 grams to 0.53 grams, mold inhibitor 0.11 grams to 0.93 grams, sodium 1.3 grams to 11.88 grams, chocolate liquor 0.55 grams to 10.61 grams, ethyl alcohol 0.013 grams to 10.1 grams, peppermint oil 0.01 grams to 4.6 grams, spearmint oil 0.11 grams to 3.55 grams, and emulsifier (polysorbate 80) 0.003 grams to 3.665 grams.

Exemplary Formulation 16 of the snuff: 488.0 grams to 505.0 grams steam distilled biomass that pass through a 1/16 stainless steel screen (mesh), 218.0 grams to 247.8 grams water, bamboo fiber 0.01 grams to 5.67 grams, myrcene 0.01 grams to 0.44 grams, humulene 0.001 grams to 0.88 grams, α-Pinene 0.124 grams to 0.66 grams, β-caryophyllene 0.088 grams to 0.53 grams, mold inhibitor 0.11 grams to 0.93 grams, sodium 1.3 grams to 11.88 grams, chocolate liquor 0.55 grams to 10.61 grams, strawberry extract 0.12 grams to 8.44 grams emulsifier (polysorbate 80) 0.003 grams to 3.665 grams, and mono-diglyceride 0.001 grams to 0.167 grams.

Exemplary Formulation 17 of the snuff: 503.0 grams to 566.0 grams steam distilled biomass that pass through a 1/16 stainless steel screen (mesh), 218.0 grams to 247.8 grams water, bamboo fiber 0.01 grams to 5.67 grams, myrcene 0.01 grams to 0.44 grams, humulene 0.001 grams to 0.88 grams, α-Pinene 0.124 grams to 0.66 grams, β-caryophyllene 0.088 grams to 0.53 grams, mold inhibitor 0.11 grams to 0.93 grams, sodium 1.3 grams to 11.88 grams, chocolate liquor 0.55 grams to 10.61 grams, emulsifier (succinated esters) 0.003 grams to 3.665 grams, and almond oil 0.12 grams to 7.22 grams.

Exemplary Formulation 18 of the snuff: 505.0 grams to 577.0 grams steam distilled biomass that pass through a 1/16 stainless steel screen (mesh), 218.0 grams to 247.8 gram water, bamboo fiber 0.01 grams to 5.67 grams, myrcene 0.01 grams to 0.61 grams, humulene 0.001 grams to 0.155 grams α-Pinene 0.124 grams to 0.012 grams, β-caryophyllene 0.001 grams to 0.66 grams, mold inhibitor 0.011 grams to 0.20 grams, sodium 1.3 grams to 11.88 grams, emulsifier (polysorbate 80) 0.003 grams to 3.665 grams, sorbitan esters 0.17 grams to 5.43 grams.

Some embodiments may include an oil mixture comprising five percent licorice oil and 95 percent propylene glycol.

In some embodiments, the ingredients of the flavoring compound may vary+/− of 0.5% above or below the stated limits without compromising the flavor profile. Snuff products are often sold as moist products. The water and salt mixture in the flavoring compound forms a saline solution to increase the moisture content of the hemp snuff. Snuff products are typically sold in cans and can be prone to molding. The ethanol in the flavoring compound is added as a mold inhibitor. The ethanol, which may be food or pharmaceutical grade, will evaporate over time. Utilizing an oil based liquid rather than a powder based liquid for the flavoring compound is advantageous, as the liquid flavoring compound will be absorbed into the steamed hemp biomass rather than only coating the hemp biomass without absorption. An object of the invention is to create an application for leftover spent biomass in the hemp industry. Spent biomass can be used for many things, from animal feed to energy such as pyrolysis or gasification.

In some embodiments, the snuff generally includes hemp biomass, oils, surfactants and or emulsifiers, flavonoids, terpenes, aromatic compounds, acids, acidulants, emulsifiers, terpenes, and terpene oils.

Terpenes are organic aromatic molecules that contribute to health benefits associated with hemp and hemp derived products. Exemplary terpenes that may be included in the formulation of the snuff include primary, secondary, tertiary, and or a combination of the primary, secondary and tertiary terpenes. While certain terpenes are described herein, these exemplary terpenes are not intended to be an exclusive list and those skilled in the art will understand that various terpenes may be added to enhance flavor profiles or to produce desired physiological or psychological effects.

The mechanisms and action(s) of terpenes, acids, emulsifiers, antagonist proteins, sugars molecules, and compounds effect on taste perception should not be considered independently from mastication and saliva properties. Saliva contains thousands of proteins. The initial process of taste perception, saliva provides a medium as a solvent for substances and the digestion of foods. Saliva aids in its ability to protect taste receptor cells from mechanical, thermal, bacterial and viral aggression, and transference of taste molecules to taste receptors. The basal secretion of saliva constitutes a reference environment to which taste receptor cells are selected through specific pathways. Thus, stimulus concentrations should exceed saliva concentration to elicit a response of both saliva and the compounds specific to regions on the tongue surfaces. Sodium and or sodium chloride increase the saliva volume thus allowing additional compounds to become effective at lower concentrations.

The taste buds are in the epithelial layers without being partitioned by various membranes or any other type of tissues from surrounding epithelial cells. The taste buds for the sweet are on the tip of the tongue whereas salty taste buds are present on either side of the front tongue portion, sour taste buds are present behind the front portion of the tongue. Bitter taste buds are present in the back portion of the tongue. The center of the tongue contains very few taste buds.

In some embodiments of the snuff, certain acids and acidulants that may be used in conjunction with another in the process, manufacturing, formulation of the snuff.

Acidulants are substances (organic or inorganic) which release hydrogen and a salt part in water solution. When the concentration of hydrogen ions goes up, then the acidity of the whole system is increasing and the pH is decreasing. Human saliva is slightly acidic (pH approximately 6.8) by the use of acids and or acidulants thus reducing the pH range between 1.25 to 5.5 and when we consume sour food or drinks, our taste receptors interact with the acids present in the food or drink and this sensation is recognized by us as sourness and or bitter.

Acidulant are acids that either found naturally in vegetables, and fruits or are used as additives in food, food derived food, beverage, and pharmaceutical medicine formulations. Mainly, tartaric acid adipic acid fumaric acid, citric acid, phosphoric acid, lactic acid malic acid and acetic acid are used to play different roles in different food components. Some functions of acidulants when used in a formulation of the snuff include: provide sourness and or bitter notes; act as buffer to control acidity level; enhance flavors; increase palatability by balancing the sugar to acid ratio; functions as a mild preservative by regulating pH; serves as wetting medium by increasing flow of saliva. Taste buds—The tasting, or gustatory, cells in the buds contain microvilli which detect chemicals in solution (secreted by the gland at the bottom of papilla). When stimulated by flavonoids and or terpene molecules, these cells generate nerve signals, which they send to the taste center on the brain's cortex, and also to the hypothalamus, which is concerned with appetite and the salivating reflex. Use of specified terpenes and antagonist (acids) as ingredients in formulas of the snuff support its desired flavor profile, thus eliminating the desire of the addictive substance in nicotine and tobacco constituents.

Taste buds consist of several different categories of cells, generally classified as Types I, II, III and IV. Functional characterization of taste cells indicates that one of these categories, Type II, represents receptor cells. These cells express G protein coupled taste receptors (T1Rs, T2Rs) and their downstream effectors, phospholipase C subtype β2 (PLC β2) and IP3 receptor subtype 3. Consequently, receptor cells are directly stimulated by sweet, bitter and umami taste compounds).

In response to taste stimulation, receptor cells secrete ATP, a taste neurotransmitter, via an unconventional mechanism gap junction hemichannels composed of the pannexin 1 gap junction protein. Receptor (Type II) cells, however, may not directly participate in sour taste.

Other taste cells, possibly Type III cells, appear to be acid sensitive, although this has only been tested to date in situ. Type III cells form morphologically identifiable synapses with postsynaptic structures and have been shown to express molecules associated with vesicular exocytosis. Type III cells also express a candidate acid transducer channel, PKD2L1. These cells have been termed presynaptic cells to underscore the observation that they possess synapses and express synapse-related proteins. When stimulated, presynaptic Type III cells release serotonin (5-HT) in a calcium-dependent manner, consistent with vesicular exocytosis at synapses.

Taste nerve pathway—The nerve signals are carried by three nerves in each side of the tongue (cranial nerves) to a small part of the medulla (brain stem). The signals then travel to parts of the brain, such as the hypothalamus, the thalamus, and the gustatory part of the sensory cortex—the "taste center", where the signals are interpreted. The thalamus acts like a relay station, delivering the data onto appropriate cortical areas for processing.

Papillae—The papillae are those small elevations visible to the naked eyes. There are three types of papillae located from the back of the tongue toward the tip. Filiform papillae are generally conical or pointed; fungiform papillae are flat-toped; vallate papillae are larger with an outer groove. Many taste buds lie along the walls of the papillae. Isolated ones also are present on the palate, the pharynx, and the epiglottis.

Gustatory receptors are a divergent group of non GPCR transmembrane chemoreceptors that are expressed in sensilla receptors, they detect tastants (non-volatile compounds), through sensory gradient of chemo sensation.

The stimulus is initiated in taste receptor cells which lead to depolarization and neurotransmitter release into afferent nerve fibers which assist in transmission of signals to the central nervous system and help to perceive taste.

The central nervous system is also responsible for differentiating between two tastes on our tongue. The stimulus is initiated in taste receptor cells which lead to depolarization food central nervous system and help to perceive taste. The central nervous system is also responsible for differentiating between two tastes on our tongue.

Citric Acid Monohydrate $C_6H_8O_7H_{20}$ (citric acid) is widely used food acidulant. It has excellent solubility, very low toxicity, chelating ability, and pleasantly sour taste. According to the FDA, citric acid and its sodium/potassium salts is GRAS food additives. As are the additional mentioned acids and/or acidulants listed below.

Citric Acid is an organic used as a flavoring and preservative. A central metabolic pathway found in plant. Citric Acid may contribute to both the flavoring component and used as a preservative, for example, of snuff. Citric Acid used in the snuff may be used to increase its astringent influence.

Tartaric Acid $C_6H_6O_6$ (tartaric acid) has a strong, tart taste and synthetic fruit flavors, mainly grape and cranberry. As an ingredient of the snuff, tartaric acid may influence specific terpene flavonoids and flavins providing a hydrogen ion concentration, which assists with providing a burst of flavor to make a mouth water and assist with the bite sensation. It is utilized in food and in plant or vegetable products or by-products. High prices and limited availability inhibit tartaric acid from widespread use as a food acidulant.

Malic Acid $C_4H_6O_5$ is a natural organic compound. Malic acid is used in a variety of products including many foods and food stuff, such as hemp, for example. As an acidulant, malic acid contributes and enhances flavor and stabilizes the color of plant synthesis. In Hemp or Hemp bio-mass and or by-product, Malic Acid contributes a bitter profile while compensating a specific pH range that supports a favorable bitter background note, described as bite.

Fumaric Acid is principally used in foods as a pH influencer. Fumaric acid competes with other acidulants such as citric acid and tartaric acid. Although it is less costly than some alternatives, its relatively strong acid taste and low solubility. Fumaric acid preserves the color and pH of the snuff 100 by adjusting the hydrogen ion concentration and/or the pH concentration in an alkaline state to preserve it in a green state.

Phosphoric acid $H_3PO_4$ and its salts account for one fourth of all the acids used in the food industries. Phosphoric acid has a tartness and flavor and is used almost entirely in beverages flavored with higher water activity. It is strong, giving the lowest attainable pH. Including phosphoric acid in a formulation of the snuff assist with maintain a preservative pH value between 2.5 and 8.3, for example.

Ascorbic Acid $C_6H_8O_6$ acts as antioxidant used in many foods or food by-products. There are certain other acids such as adipic acid, acetic, and lactic acid that may also be used as acidulant in food and plant derivatives in combination with other major acids. In the use of Hemp or Hemp By-Products, ascorbic acid contributes to the bite of the snuff.

Lactic Acid $C_3H_6O_3$ is a white solid when added to water becomes colorless. Lactic acid is an Alpha Hydroxy Acid. It may be used as a preservative in the snuff, a processing aid, and in the preservation and in the prevention of discoloration. The alkalinity of chlorophyll is changed to chlorophyllin thus preserving the decolorization.

Acetic Acid $CH_3COOH$ is an acidic colorless liquid and an organic compound. If included in a formulation of the snuff, acetic acid will contribute to a sour profile.

Butyric Acid $CH_4H_8O_2$ is an agonist as a free fatty acid molecule which influences the free fatty acid receptors, such as FAAR2 and FAAR3, which function to flavor and aromatic profiles as a nutrient and contributes to flavor and aromatic profiles when included in a formulation of the snuff.

Propionic Acid $H_3CO_4$ is classified as a weak acid and astringent. The pure compound of Phosphoric Acid is a colorless solid. Phosphoric Acid is an important oxygen acid. When included in a formulation of the snuff, phosphoric acid contributes to the bite of the snuff as well as contributing as a preservative and preservation of coloration properties.

Recent findings suggest that acid tastants, such as Caprylic Acid $C_6H_{16}O_2$, act by the activation of a subset of bitter neurons and inhibition of sweet neurons. Bitter neurons begin to respond at pH 5 and show an increase in spike frequency as the extracellular pH drops, which does not rely on previously identified chemoreceptors. Notably, sweet neuron activity depends on the balance of sugar and acid tastants concentrations. This is independent of bitter neuron firing and allows neurons to differentiate between bitterness and sourness. When included in a formulation of the snuff, these two mechanisms are operable to modulate the desired flavor profile.

In some embodiments of the snuff, terpenes may be used or in the products, formulations, processes, and manufacturing of the snuff.

A terpene, Myrcene $C_{10}H_{16}$, is a natural alkaline hydrocarbon and makes up about 65% of cannabis (hemp) essential oil. Being one of the major terpenes in Hemp, Myrcene gives Hemp most of its earthy, fruity, clove-like and pungent aroma. In thyme, Myrcene can be up to 40% of the weight of wild thyme leaves. B-Myrcene has sedative as well as motor relaxant effects. Myrcene can also be found in Lemon Grass among other sources.

A terpene, Alpha-Pinene $C_{10}H_{16}$, is an alkaline hydrocarbon found in eucalyptus oil and notably in Rosemary and has an aromatic profile. Its characteristic profile is a spicy, woody pine aroma. It is widely encountered terpene in nature and has a wide range of medicinal properties. Several studies revealed Alpha-Pinene has anti-inflammatory, antibacterial, and antimicrobial properties.

A terpene, Guaiol $C_{15}H_{26}O$, is a bicyclic sesquiterpenoid. Guaiol possesses antimicrobial, antioxidant, anti-inflammatory, and antiseptic properties. Guaiol has flavors of rose and ginger and balsamic profiles.

A terpene, Cis-beta-ocimene $C_{10}H_{16}$, is a rare terpene which differs slightly from trans-beta-ocimene due to the location of its functional groups relative to the hydrocarbon chains contained within this type of monoterpene. Found within a variety of plants and fruits ranging from orchids to mangoes, *Verbena* and juniper, including elevated concentrations in Hemp. cis-ocimene is characterized by its woodsy, earthy aroma and floral background notes which contribute to its use in perfumes and fragrances. Apart from its fragrance, cis-ocimene features several therapeutic benefits including antifungal microbial activity along with antitumor activity. It is used as a flavoring but regarded for its floral spice aroma.

A terpene, Juniper Camphor $C_{15}H_{26}O$, is found in Ginger, Raspberry, Huckleberry, and Loganberry. Juniper Camphor has a strong aromatic profile. In food it is used in both sweet and savory dishes. The Camphor molecule is used for multiple medicinal purposes, such as anti-fungal and antioxidant properties. Camphor is FDA approved as anti-cough and FDA approved analgesic and antiseptic.

A terpene, Beta-Curcumene $C_{10}H_{24}$, is a sesquiterpene found in turmeric. Like other terpenes derived from the turmeric plant, beta-curcumene identifiable aromatic of spice and ginger and mango of components in fragrances, foods and cosmetic industry. Beta-Curcumene has a flavor profile of spice and bitterness. Beta Curcumene has anti-inflammatory, antimicrobial, and antioxidant properties.

A terpene, Terpinolene $C_{10}H_{16}$, is a monoterpene found in lilac, nutmeg, herbaceous, and in lime. Terpinolene and is slightly citrusy and has antifungal, antiseptic, antibacterial properties.

A terpene, Camphene $C_{10}H_{16}$, is a terpene typically found in fruits, carrots, pepper, dill, fennel, nutmeg, ginger oil, mango, and thyme. This monoterpene used in fragrances and food flavor as an additive due to its minty and citrus characteristic and spicy notes. It is recognized primarily for its medicinal properties, which include anti-inflammatory, antibiotic, antioxidant, analgesic, and antifungal effects.

A terpene, Alpha Terpinene $C_{10}H$, which has a strong lemon odor, is a gamma-terpinene widely used in food, flavors, cosmetics, pharmaceuticals, tobacco, confectionery, and perfume industries. Antioxidant activity and anti-fungal activity have been studied for anti-inflammatory benefits. Alpha-Terpinene is commonly found in lime, allspice, cardamom, marjoram, and citrus. Its woody, lemony and citrusy aroma contribute to its popular use as a fragrance and flavor compound. Apart from its use as a food additive due to its lemony flavor, on a therapeutic level, alpha-Terpinene is known for its antioxidant properties.

A terpene, Aromadendene $C_{15}H_{24}$, is a sesquiterpene naturally found in sunflower, rosemary, sweet bay, sweet marjoram, and citrus oils. Aromadendene aroma profile is one of woodsy. It is often used in pharmaceutical, mouthwash, toothpaste, inhalers, and hygiene applications.

A terpene, Eucalyptol $C_{10}H_{18}O$, has been shown to be effective in treating anti-inflammatory and advanced respiratory disorders as a cytokine inhibitor. Uses often include toothpaste, mouthwash, flavorings and fragrances. With its cooling, minty flavors, Eucalyptol is a common ingredient in gum, hard candies and beverages.

A terpene, Linalool $C_{10}H_{18}O$, occurs in over 200 species of plants. Linalool terpene usually constitutes 5% or less of cannabis essential oil and has pleasant floral notes, gentle spiciness back note. Linalool possesses antimicrobial, anticancer, anti-inflammatory and antioxidant compounds. Found in lavender, sweet basil, tomato, grape, mango, lemon oil and tea. Typical uses include foods, beverages, chewing gum, ice cream, and meat products.

A terpene, Fenchyl $C_{10}H_{18}O$, has the sensory profiles of pine and citrus, herbal and lemon, fenchyl brings spicy, woody and slightly bitter notes to the food it flavors and refreshing, piney smells to fragrances it's incorporated in. Fenchyl can be found in the essential oils of citrus peel, fennel, nutmeg, basil, and asters. Fenchyl contributes to its antimicrobial, anti-inflammatory, and anti-oxidant properties.

A terpene, Beta Pinene $C_{10}H_{16}O$, is one of the most abundant compounds in trees, especially coniferous trees. Beta Pinene possesses aromatic compounds and fresh minty, eucalyptus, spicy, peppery nuances. This monoterpene is known for its antibacterial effects as well as antidepressant-like and sedative-like activity.

A terpene, Citronellol $C_{10}H_{20}O$, is a terpene and a natural occurring scent that can be found in a variety of herbs and spices, including black pepper, lavender and chamomile, as well as in the essential oils of Buchu leaves and Mairehau roots. It has rich aromas of rose, citrus, lemon and melon. Though Citronellol may be best known for its insect-repelling capabilities, this terpene and has become one of the most widely used topical products. 80% percent of Citronellol oil is derived from Kefir lemon leaf.

A terpene, Borneol, has a sharp piney odor and has a wide use in the cosmetics and drugs industry. It's been suggested that its burning taste is reminiscent of mint. Borneol has been identified in more than 250 essential oils from plants, herbs, leaves or bark and has been used in traditional Chinese medicine for thousands of years. Found in Cinnamon.

A terpene, Citronellal $C_{10}H_{26}O$, is a monoterpenoid. It is a colorless, pale to yellow liquid. As its name suggests, citronellal can be found in the essential oils of citrus fruits such as lemon, lime, and kumquat, and lemongrass. A fragrance staple because of its alluring blended aroma of rose and lemon. Citronellol terpene's citrusy flavor adds zest to desserts and candies. As a therapeutic agent, citronellal is primarily used to treat fungal infections. However, scientists are exploring additional use cases for citronellal, including but not limited to using citronellal for anti-inflammatory and antioxidant purposes.

Terpenes, D/L-Fenchone (D-fenchone and L-Fenchone $C_{10}H_{16}O$), are the two enantiomers that make up the monoterpene Fenchone. D-Fenchone is found in the essential oils of ginger, rosemary, and fennel, as well as in thyme and licorice. Possess a wild, bitter fennel taste profile. L-Fenchone is derived from fennel and wormwood.

A terpene, Geraniol $C_{10}H_{18}O$, a monoterpene, geraniol is found in many essential oils, including rose, citronella, and lavender. As a flavoring, geraniol is often used to reproduce the sweet, deep summer fruit tastes of plum and watermelon. The biological attributes for Geraniol are anticancer, antibacterial, anti-inflammatory. Typically used in ice cream, candies, insecticides and cosmetics.

A terpene, D-limonene $C_{10}H_{16}$, D, has an aromatic compound profile sweet and citrusy monoterpenes. D-limonene properties and benefits are well documented and include anti-inflammatory, antioxidant, antinociceptive, anticancer, antidiabetic, antihyperalgesic and antiviral effects. Found in orange, caraway and dill. Typically used in flavorings, fragrances, beverages, distilled spirits and cosmetics.

A terpene, 3-Carene $C_{10}H_{16}$, a monoterpene, is found in the essential oils of basil, fennel, kumquat and lime. 3-Carene a sweet pungent woody, damp musty resembling cedar and pine needle odor. Found in rosemary, lime, kumquat basil and fennel. Typically used in cosmetics, pharmaceutical, and pesticides. 3-Carene is found to contain antimicrobial, anti-inflammatory and antibacterial properties A terpene, Geranyl acetate $C_{12}H_{20}O_2$, is a monoterpene. This is a natural organic compound with a pleasant floral, rose aroma. Geranyl Acetate is found in citronella, rose, lavender, geranium, coriander, and carrot. Geranyl is typically used in cosmetics, pharmaceutical and flavorings. Geranyl has a purely sweet fruity, citrus aroma. Geranyl Acetate is found to contribute to its anticancer and anti-inflammatory properties.

A terpene, Alpha-Phellandrene $C_{10}H_{16}$, a monoterpene, is found in herbs and preserved foods, including cured pork, celery leaves, eucalyptus and dill. Alpha Phellandrene scent is described as a mixture of pepper, mint, wood and fruit. Alpha-phellandrene is used in flavorings and perfumes. Alpha-phellandrene has a refreshing flavor of light citrus. As a therapeutic agent, alpha-phellandrene has been shown to be effective against liver cancer, antibacterial and antioxidant qualities. Found in Eucalyptus, balsam oil, and citrus.

A terpene, Linalyl Acetate $C_{12}H_{20}O$, is a monoterpene and a natural occurring phytochemical. Found in rose, lavender, peach and sage. Linalyl acetate has a pleasant fruity appealing flavor blend of citrus, herbs, and spice. Typically used in in prepared desserts, beverages, and meat products. Linalyl Acetate has been identified to have antimicrobial, anti-inflammatory, and antifungal properties.

A terpene, Isopulegol $C_{10}H_{18}O$, is a monoterpene that is a naturally occurring compound. Isopulegol is characterized by minty tastes found in spearmint and rum. Uses include personal care, beverages, flavorings and insecticides. These same aromatic nuances of spearmint and fruit have contributed to its frequent inclusion in hygienic products, cosmetics and perfumes. Isopulegol has health and agriculture benefits, including to prevent premature sprouting and gastrointestinal influences. Found in lemon grass, lemon balm, geranium and eucalyptus.

A terpene, Carvone $C10H_{14}O$, is a naturally occurring compound. Found in caraway, dill and spearmint. Carvone has a sweet minty aroma profile. Carvone uses include chewing gum, mint candies, personal care and flavorings. Carvone has been described to contribute to aid gastrointestinal issues. Used in agriculture to prevent premature sprouting of potatoes.

A terpene, Gamma Terpinene, is a flavone of polyphenol. One of three terpinene isomers, this monoterpene is a significant component of citrus fruits but can also be found in a variety of herbs and essential oils. Y-Terpinene has a particularly beguiling aromatic blend of lime and tropical sweetness Quercetin—Terpene Described A terpene, Quercetin, is a flavone of polyphenol that has multiple influences on immune system function. Found in fruits, vegetables, tomatoes, onion, kale, green tea, apples and berries. Quercetin is an antioxidant, anti-inflammatory, antiviral activities and assists in the killing of certain cancer cells.

A terpene, Citronellal, is frequently utilized in fragrances. The monoterpene's lush, citrussy tastes are used as food flavorings in savory dishes, desserts and beverages. In recent years the medical community has uncovered several therapeutic benefits of γ-Terpinene, including antifungal qualities and antioxidant properties that have been linked to slowing the progression of diabetes and Alzheimer's disease. Found in Laurel Bay Leaves.

A terpene, Sabinene Hydrate $C_{10}H_{16}$, is a monoterpene found in marjoram, Norway spruce. One compound of Sabinene contributes to the spiciness of black pepper and a major constituent of carrot oil and green tea oil. Sabinene has a woody taste profile. Found in nutmeg. Sabinene is recognized for anticancer, anti-inflammatory, and antioxidant properties. Sabinene is typically used in pharmaceutical, cosmetic and flavorings.

A terpene, Nerol $C_{10}H_{18}O$, is found in lemongrass, hops and hemp. Nerol has an intense suave flower rose like aroma profile. Nerol has a woody, tea like citrus taste with fruity and herbal nuances. Health attributes are antimicrobial, antioxidant and antifungal. Nerol plays a significant role in determining the flavor and aroma of rose and palmaroseoil, which can be found in large quantities. Thanks to its fragrant mixed rose and citrus aroma compounds. The terpene is a common ingredient in the fragrances industry. With its enticing taste of fresh fruit and light floral touches, Nerol is often combined with other additives to create popular fruit flavors like, raspberry and red apple. The terpene is used to treat sepsis, bacterial infections and is also effective at soothing and healing topical conditions, such as acne and minor contusions Found in Tuberose.

A terpene, Sabinene $C_{10}H_{16}$, a terpene that's primarily produced in black pepper, the essential oil of carrot seeds and in specific varieties of oak and spruce. Sabinene's warm, spicy aroma is used in a variety of fragrances products. The monoterpene's peppery flavor can be found sprinkled throughout most sectors of the processed food industry. Traditional medicine extolls Sabinene's influence on the immune system, including Sabinene's potency in fighting bacterial infections and cancer. Found in Carrot seed oil, tree tea oil, nutmeg and turmeric.

A terpene, Thymol $C_{10}H_{14}O$ (Thyme), is antibacterial, antifungal, sedative, antiseptic, antioxidative, expectorant, antispasmodic, antifungal, antihidrotic, anthelminthic, carminative and has diaphoretic effects. Thyme contains terpenoids, flavonoids, glycosides and phenolic acids. The primary flavor component of its namesake, thyme, Thymol is also found in an abundance of fruits, herbs, and cheese, including blueberry, mango, licorice and Gruyere. With a forest taste profile of wood and spice, sweet aroma, Thymol lends itself well to hard candies and dessert. As a natural disinfectant, Thymol is an established healing agent in septic, fungal, and bacterial disorders. As such, the terpene is a key component in oral healthcare products such as toothpaste and mouthwash. Found in Thyme.

A terpene, Bornyl Acetate, is primarily produced from pine tree oils, although it also occurs naturally in other plants including thyme, rosemary and coriander. The terpene's heavy pine smell has made it popular with industries that appeal to the sense of smell, from fragrances to cleaning solutions. As mirrored images of each other, the d and l forms of the terpene have different molecular structures; l-Bornyl Acetate features a sweeter but milder flavor and aroma profile than its d twin. Medicinal properties associated with the terpene include anti-infection, anti-inflammatory and relaxation qualities. Found in Sage.

A terpene, Alpha-Terpineol α-Terpineol, monoterpene, is a major component of pine oils. Moreover, it is present in small amounts in many other essential oils such as eucalyptus and cajeput. It is one of five common isomers of terpineol. Besides its important role in the industrial field, α-Terpineol offers a wide range of medical properties as a local anesthetic, anticancer, anti-inflammatory and antihypertensive compound. Found in Lime.

Sesquiterpenes are a class of terpenes that consist of three isoprene units and often have the molecular formula $C_{15}H_{24}$. Like monoterpenes, sesquiterpenes may be acyclic or contain rings, including many unique combinations. Biochemical modifications such as oxidation or rearrangement produce the related sesquiterpenoids. Sesquiterpenes are found naturally in plants and insects, as semi chemicals, defensive agents or pheromones.

A terpene, Quercetin, has multiple influences on immune system function, aside from its most commonly known mast cell stabilizing activity. Quercetin smells like rubber because it is a sulfur compound. Found in Red Onion.

A terpene, Beta-Farnesene, is known to have anti-inflammatory, calming, antispasmodic, antibacterial, antifungal, and sedative properties. Its scent is characterized as a woody, green vegetative smell with a lavender background. Found in Ginger.

A terpene, Isoborneol, has properties that give stability to scent and has a distinctive healing scent, characterized by spicy, woody aroma. Used in many quality commercial products. Found in Camphor.

A terpene, Cis-Citral, has a strong citrus scent. Cis-Citral lemon odor is less intense, but sweeter. This small molecule is therefore a relaxing aroma used in perfumery for its citrus effect. Cis-Citral is also used as a flavor and for fortifying lemon oil. It also has strong anti-microbial qualities, and pheromonal effects in insects. Found in Carrot.

A terpene, Beta-Caryophyllene, is characterized by its spicy and peppery odor. This sesquiterpene is most commonly found in cloves, black pepper, basil, oregano and cannabis. There are 3 isomers (A, B, and Y-caryophyllene) in nature, however B-Caryophyllene is the most frequently encountered and most abundant of the isomers. In addition, as an outstanding feature, B-Caryophyllene is suggested to bind with CB2 receptors and activate the endocannabinoid system. B-Caryophyllene does not produce a psychoactive effect. Found in Black Pepper.

A terpene, Ledene, is a naturally-occurring sesquiterpene of the Australian Tea Tree's essential oil. Ledene is also found in small quantities in the essential oils of certain myrtle plants, sticky cassinia, and mint bush. Though ledene is not safe for consumption, the sesquiterpene's light, minty aroma has made it a standard component of cosmetics and soaps. In aromatherapy, ledene is lauded for its ability to boost the body's immune response and mitigate respiratory disorders. However, ledene is equally prized for its ability to relieve skin conditions like contusions and burns. Found in Tea Tree.

A terpene, a-Curcumene, is an herbaceous terpene found in rosemary and in high concentrations in the essential oils of ginger and turmeric. Curcumene belongs to the Sesquiterpene family. As an isomer of curcumene, α-curcumene plays a significant role in creating the turmeric spice's nutrient-rich, exotic flavor profile. Long before the advent of modern medicine, α-curcumene figured largely into traditional medicine in the form of turmeric-based cures for gastrointestinal discomfort, tumors and cardiovascular disorders. More recent scientific research has established α-curcumene's potency in treating rheumatic conditions as well as inflammation of the digestive tract. Found in Rosemary.

A terpene, Alpha-Bisabolol, is the primary source of this colorless sesquiterpene is German chamomile. Therefore, it has a pleasant light floral odor and has been shown to have anti-nociceptive and anti-inflammatory activities. Furthermore, it has been shown to help improve sleep quality. Terpene a-Bisabolol is well suited for use in skin care products and can be useful in both sensitive skin and child/baby products as a soothing ingredient. Found in Chamomile.

A terpene, Alpha-Humulene, is named for the plant where it was first extracted from, *Humulus lupulus*, also known as hops. Humulene can be up to 40% of the hops' essential oil. In addition, its oxidation products in the brewing process give many beers their pleasant hoppy aroma. It has been shown to have anti-inflammatory and antitumor activities. Found in Hops.

A terpene, Alpha-Gurjunene, Alpha-Gurjunene is found in some species of pearly everlasting and the thistle family of plants. With a spicy, woody aroma, Alpha-Gurjunene is often used to enhance fresh-smelling fragrances and cosmetic products. Similarly, its deep notes of spice and wood are used to flavor a variety of savory and dessert foods. The research community is continually discovering new therapeutic properties of Alpha-Gurjunene. The sesquiterpene has to date been shown to be valuable when employed against cancer and inflammation, is effective against ticks and can be used to dull pain. Found in Anophalis Nubigena.

A terpene, Trans-Nerolidol, is one of the two isomers that make up the Nerolidol sesquiterpene. This sesquiterpene is found in many aromatic herbs and plants, including ginger and jasmine, as well as in the essential oil neroli from which it takes its name. The terpene's fresh, forest scents of rose and citrus are used in cosmetics and household products, and its fresh, earthy taste makes it a common flavoring ingredient. Trans-Nerolidol's medicinal qualities are also well-documented. Recent research highlights Trans-Nerolidol's success in combating parasite-borne diseases and parasites, fungal infections, and in aiding antibiotics against bacterial infections. Found in Neroli.

A terpene, Caryophyllene Oxide, has a sweet, woody aroma and is mainly found in lemon balm and geranium. It is the product of the oxidation of Caryophyllene. Furthermore, it's the component responsible for cannabis identification by drug-sniffing dogs. It is believed to be the only terpene in cannabis that has the ability to successfully bind with CB2 receptor. This unique skill makes it highly beneficial for medicinal uses, However, Caryophyllene Oxide only has a few known medical benefits. Found in Black Pepper.

A terpene, Beta Cedrene, along with a-Cedrene, B-Cedrene is one of two isomers that form Cedrene, a sesquiterpene derived from the essential oils of cedar. Like α-Cedrene, B-Cedrene's crisp scents of pine and wood have contributed to its widespread use in fragrances, cosmetics, while its gentle sweet taste has seen it incorporated in beverages, sweeteners and baked goods. Similar to its isomer twin, B-Cedrene is a valued compound in traditional and holistic medicine. Studies have confirmed its therapeutic potency as anti-inflammatory, antiseptic, and diuretic, among its many medicinal qualities. Cedrene is still being researched for its effects on testosterone and fat loss, but preliminary evidence is promising. Found in Pine.

A terpene, Valencene, is named for the Valencia oranges in which it is found in high concentrations. Valencene is also produced in the peel and juice of many citrus plants and within other fruits and herbs. With its refreshingly sweet scents of citrus and wood, Valencene is a widely used component in fragrances, cosmetics and personal hygiene products. The terpene's strong citrusy flavor is routinely added to desserts, dairy products and breakfast cereals. As a bronchodilator, Valencene can ease respiratory conditions, and recent research has demonstrated the terpene's effectiveness against dermatological inflammations such as atopic dermatitis. Found in Orange.

A terpene, Alpha Cedrene, a-Cedrene is one of two isomers that make up Cedrene, a sesquiterpene that, along with Cedrol and Cedrenol, constitutes the sensory profile of the essential oils of cedar. This isomer's bracing aromas of fresh wood and pine have made it a common component of fragrances, cosmetics and hygienic products, while its mildly sweet taste has turned α-Cedrene into a recurring dessert and beverages ingredient. Used by holistic medicine practitioners as an antiseptic and mucolytic agent, recent scientific research suggests that α-Cedrene could be effective against tumors and bacterial infections. Found in Pine.

A terpene, Thujopsene, along with Cedrol, Thujopsene is one of the main components of the varied essential oils of conifers. Thujopsene woody, fresh aromas greatly contribute to these oils' use in aromatherapy as a soothing and even sedative agent. Frequently associated with other warm pine and citrus aromas popular in the cold winter months, Thujopsene is a common ingredient in hygiene products such as deodorant and shampoo as well as fragrances. The terpene is often used to combat topical conditions thanks to its antifungal, anti-septic and anti-inflammatory properties, though as an expectorant it is also effective against mild respiratory disorders. Found in Canary Island Juniper.

A terpene, Alpha-Farnesene, is one of six Farnesene sesquiterpenes, α-Farnesene can be found in the peel of apples as well as in the fruit and essential oils of lemon and lime. Its alluring flavor profile blend of berry, herbal green and flowery notes explain a-Farnesene's inclusion in the ingredient list of savory and sweet products from all across the food industry. α-Farnesene has been shown to be very effective against inflammation and is known for its ability to alleviate stress and muscle spasms. Recent research additionally points to α-Farnesene as an integral compound in stopping tooth decay. Found in Jasmine.

A terpene, Cis-Nerolidol, is one of two Nerolidol isomers, is found in many essential oils, fruit, vegetables and herbs, including in its namesake, Neroli citrus oil. This terpene's fresh wood and fruity tones contribute to its extensive use as a dessert flavoring agent, as well as an aromatic in fragrances and hygiene products. The therapeutic benefits of Cis-Nerolidol are widespread and well-documented, including the inhibition of tumors and fungus as well as possessing antioxidant and antibacterial qualities. Other suggested medicinal use cases of Cis-Nerolidol include inducing drowsiness and soothing topical conditions. Found in Neroli.

A terpene, Cedrol, is a musky terpene that is present in Juniper and other essential conifer oils, as well as in some herbs. This terpene's floral, woody aromas have made it a staple of hygiene and fragrance products, with both industries eager to capitalize on Cedrols lush forest perfume. Homeopathic medicine has long regarded Cedrol as an important healing compound thanks to its many demonstrated medicinal properties. In addition to serving as a sedative, Cedrols antispasmodic and astringent properties respectively relax muscles and sooth irritated skin. Like another conifer terpene, Thujopsene, Cedrol also has antiseptic, anti-fungal and anti-inflammatory qualities. Found in Cypress.

A terpene, Guaiazulene, is a derivative of Azulene, Guaiazulene is found in the essential oils of German chamomile and guaiac. Marked by its aromatics of rose and sandalwood, Guaiazulene is a much sought-after ingredient of fragrances and high-end soaps. Traditional medicine has long considered Guaiazulene to be one of the more potent terpenes of healing, and modern medicine has begun to confirm Guaiazulene's immense psychological and physiological benefits. From an emotional perspective, Guaiazulene has been shown to boost feelings of happiness and peacefulness. The terpene's long list of physiological benefits include analgesic, anti-inflammatory, and nervine properties. Found in Chamomile.

A terpene, Farnesol, is a terpene alcohol that can be found in over 30 essential oils, with an especially high concentration in the tropical Cabrueva oil. Thanks to its summery fruit flavors of peach, apricot and grapes, Farnesol is a frequent addition to desserts and candies, while its light aromatic blend of fruit and flowers have made it a key component of perfumery. The terpene has been clinically linked to the prevention of different types of cancer, in addition to exhibiting anti-inflammatory, antibacterial and antispasmodic properties. Found in Jasmine.

A terpene, Cuparene, primarily produced by the Atlantic White Cypress tree, this sesquiterpene can also be found in the downy Japanese Enokitake mushroom. Like other conifer terpenes, Cuparene is characterized by its piney, woody aroma and its spicy, woody tang, for which it is used in desserts and chewing gum. Though the medicinal properties of Cuparene have not been explored as broadly as those of other conifer terpenes, Cuparene has been documented as being beneficial in the fight against blood cancer and for treating inflammation and bacterial infections. Found in Atlantic White Cedar.

Natural phenolic compounds play an important role in cancer prevention and treatment. Phenolic compounds from medicinal herbs and dietary plants include phenolic acids, flavonoids, tannins, stilbenes, curcuminoids, coumarins, lignans, quinones, and others. Flavonoids are the largest group of naturally occurring phenolic compounds, which occurs in different plant parts both in free state and as glycosides. Glycosides are found in the plant genera *Digitalis, Scilla*, and *Strophanthus*. They are used in the treatment of heart diseases, e.g., congestive heart failure and arrhythmia.

Below is a non-exhaustive list of diterpenes that may be included in the snuff:

Caffeine Described: Caffeine, $C_8H_{10}N_4O_2$, Caffeine an alkaloid and stimulant. Caffeine is a bitter tasing compound. Caffeine blocks the actions of the adenosine receptor. Caffeine stimulates certain portions of the autonomic nervous system. Found in Coffee beans.

Cocoa Described: Cocoa—$C_7H_8N_4O_2$ is a rich flavonoid and alkaloid with a sweet, bitter, earthy profile. The aroma compounds in Cocoa derived from the bean and seed are recognized as the following; aldehydes, esters, lactones and pyrazine. Used in beverages, foods, Long regarded as a food treat, cocoa is now used by public sector as medicine. Cocoa seed is used for infectious intestinal diseases and diarrhea, asthma, bronchitis, In some embodiments, emulsifiers and surfactants may be used in the process, manufacturing or in the formulation of the snuff, including the non-exhaustive list below:

Sucrose Esters—$C_{30}H_{58}O_{13}$; Polysorbate 20—$C_{58}H_{114}O_{26}$; Polysorbate 60—$C_{64}H_{126}O_{26}$; Polysorbate 80—$C_{64}H_{124}O_{26}$; Polysorbate 60—$C_{64}H_{126}O_{26}$; Polysorbate 20—$C_{58}H_{114}O_{26}$; Sorbitan Esters—$C_{18}H_{34}O_6$; Datem—R=H or C(O)($CH_2$) $CH_3O_9H_7$; Polyglycerol Esters—$C_{24}H_{48}O_6$; Soy Lecithin—$C_{35}H_{66}NO_7P$; Sunflower Lecithin—$C_{42}H_{80}NO_8P$; Mono and Diglycerides—$C_9H_{14}O_9$; Propylene Glycol Mono Esters—$C_2H_8O2$; Lactylated Esters—$C_{24}H_{44}NaO_4$; Polyglycerol Esters=—$C_{15}H_{19}Cl_3O_4$; Ethoxylated Esters—$C_{11}H_{26}O$; Succinated Esters—$C_8H_{14}O_4$; Fruity Acid Esters—$C_6H_{12}O_2$; Lactic Acid Esters—$C_3H_6O_3$; Guar Gum (hydrocolloid)—$C_{10}H_{14}N_5Na_2O_{12}P_2$; Locust Bean Gum (hydrocolloid)—$C_{10}H_{11}ClNa_2O_{12}P_2$; Carrageenan Gum (hydrocolloid)—$C_{23}H_{23}FN_4O_7$; Xanthan Gum (hydrocolloid)—$C_{36}H_{58}O28P_2$; Magnesium Stearate—Mg $(C_{18}H_{35}O_2)_2$; Acetylated Mono Diglyceride—$C_{22}H_{42}O_4$; Phosphated Mono and Diglyceride—$C_{21}H_{42}O_4$; CSL Calcium Sterol 2 Lactylate—$C_{48}H_{86}CaO_{12}$; and SSL 2 Sodium Sterol Lactylate—$C_{24}H_{44}NaO_6$.

In some embodiments, oils that may be used in the process, manufacturing and/or in the hemp snuff, including: Coconut oil, Corn oil, Canola Oil, Cotton Seed oil, Olive Oil, Palm Oil, Peanut Oil, Rapeseed Oil, Safflower Oil, Sesame Oil, Soybean Oil, Sunflower Oil, Almond Oil, Beech Nut Oil, Brazil Nut Oil, Cashew Oil, Hazelnut Oil, Macadamia Oil, Mongongo Nut Oil, Pecan Oil, Pine Nut Oil, Pistachio Oil, Walnut Oil Pumpkin Seed Oil, Grapefruit Oil, Lemon Oil, Orange OilLemon Oil, Lime Oil, Bitter Gourd Oil, Bottle Gourd Oil, Buffalo Gourd Oil, Butternut Squash Seed Oil, Pumpkin Seed Oil, Watermelon Seed Oil, Borage Seed Oil, Blackcurrant Seed Oil, Evening Primrose Oil, Acai Oil, Cranbe 9 Oil, Croton Oil, Cuphea Oil, Honesty Illipe Butter, Jojoba Oil, Mango Oil, Mowrah Neem Oil, Ojon Oil, Passiflora Fruit Oil, Rose Hip Seed Oil Sea Buckhorn Oil, Sea Rocket Oil, Snowball Seed Oil, Tall Oil, Tamanu Oil, Tonka Oil, Tucma Butter, South American Oil, and Ucuhuba Seed Oil.

In one embodiment, the process of manufacturing the hemp biomass may include fermentation. The process of producing snuff begins with the hemp biomass and the continuous fermentation process. In said process the natural bacterial fermentation is typically between 120 degrees Fahrenheit (48.9 degrees Celsius) to 150 degrees Fahrenheit 65.5 (degrees Celsius).

In regard to fermenting the hemp biomass, natural bacterial fermentation is a component in the production of anaerobic catabolic reactions within the biomass.

In a bacterial fermentation based system, the microorganisms breakdown the organic matter, thereby producing hydrogen. The main influences in the process of bacterial fermentation are pH, temperature, and agitation.

Use of a pure form of $H_2O$ in the short path distillation process may be used in the purification process as an $H_2O$ source. $H_2O$ as a solvent having purity with corresponding pH factors effects the purity of essential oils and terpenes.

The use of non-chemical technologies, such as electrocoagulation, nanofiltration, ultrafiltration, or reverse osmosis may be used in the purification process of short path distillation and its process.

Electrocoagulation consists of pairs of metal sheet (aluminum) called electrodes. The plates are aligned in pairs of two anodes and cathodes. Using the principles of electrochemistry, the cathode is oxidized (loss of electrons), while the anode produced aluminum hydroxyls and gains electrons. Several factors that influence the efficiency of electrocoagulation process are type of electrodes, gap between electrodes, number of electrodes, size of electrodes, configuration of metals, current density, charge loading, pH of water to be treated. The addition of supporting electrolyte and operation time and temperature are important to the overall process of providing a clear path for a pure water source.

The use of reverse osmosis is a water process that uses a partially permeable and suspended chemical species as well as biological membrane to separate ions, unwanted molecules and larger particles from a water source. In reverse osmosis, an applied pressure is used to overcome osmotic pressure, a colligative property that is driven by chemical potential differences of the solvent, a thermodynamic parameter. Reverse osmosis can move many types of dissolved and suspended chemical species as well as biological particulates (principally bacteria and fungi) from water. And is used in both industrial processes wherein the production of potable water. The result is that the solute is retained on the pressurized side of the membrane. And the pure solvent is allowed to pass to the opposite side. To be selective, said membrane should not allow larger molecules or ions through the pores (holes), but should allow smaller components of the solution (such as solvent molecules), e.g., water to pass freely.

In the normal osmosis processes, the solvent naturally moves from an area of low solute concentration (high water potential). The driving force for the movement of the solvent is the reduction in free energy of the system wherein the difference in solvent concentration on either side of the membrane is reduced. Generating osmotic pressure due to the solvent moving into the more concentrated solution (water). Applying an external pressure to reverse the natural flow of a pure solvent, thus is reverse osmosis. The Several factors that influence the efficiency of electrocoagulation process are type of electrodes, gap between electrodes, number of electrodes, size of electrodes, configuration of metals, current density, charge loading, pH of sample, addition of supporting electrolyte and operation time wherein process maybe equivalent to other membrane technology applications.

The potential use of nanofiltration provides additional membrane technology wherein provides a membrane liquid separation technology which share characteristics with reverse osmosis. In reverse osmosis said technology poses a higher rejection of virtually all dissolved solutes, wherein nanofiltration provides a high rejection of monovalent ions.

The use in combination with electrocoagulation, reverse osmosis, nanofiltration and/or ultrafiltration provide the best medium for particulate separation and filtration of solutes wherein said technologies provide a pure water source for our short path technology. Whereas nanofiltration as a standalone technology provides a particulate size between 0.002 and 0.005 μm (a measurement in the amount of a substance equal to a millionth of a mole).

The use of ultrafiltration as an additional technology with the above said technologies, wherein said technology is a pressure driven barrier to suspend particular solids, i.e., bacteria, viruses and fungi and other pathogens in which said technology produces water with very high purity as a water source.

Ultrafiltration employs a variety of filtration membranes, wherein the use of ultrafiltration as a technology provides a hydrostatic pressure, forcing an equal amount of semi permeable membrane to separate solute and particulates.

The membrane is used for separation and the concentration of any species being removed is higher near the membrane surface than it is in the bulk of the stream. This condition is known as concentration polarization and exists in all ultrafiltration and reverse osmosis separations. The concentration polarization is the formation of a boundary layer of substantially high concentration of substances being removed by the membrane.

The thickness of the layer and its concentration depend on the mass of transfer conditions that exist in the membrane system. Membrane flux and feed flow velocity are both important in controlling the thickness and the concentration in the boundary layer. The boundary layer impedes the flow of water through the membrane and the high concentration of species in the boundary layer produces a permeate of inferior quality in ultrafiltration applications relatively high fluid velocities are maintained along the membrane surface to reduce the concentration polarization effect.

Short path distillation is a method of separating compounds based on the unique physical properties wherein said may or may not use a specific boiling point, temperature range for separation of a specific molecule and which may be inclusive of a form of crystallization. One of the most common forms of distillation is by the utilization of temperature ranges, times and pH. Wherein the compound molecules are heat sensitive. Particulates and processors are short path distillates used in said separations.

Short path distillation may also be referred to as fractional distillation in which high quality distillates; essential oils wherein contain specific terpenes.

During the short path process temperature ranges, times and pH are a critical juncture in the said process and or processes of extraction. The said compounds are separated in the oil through time, temperature and pH until said compounds are transformed into vapor, wherein the said compounds are raised up and then chilled back into a liquid form using a condensing coil.

The table below includes densities of some exemplary ingredients that may be included in the snuff. It will be understood by one having the ordinary skill in the art that these densities may vary depending on the process of manufacture of the ingredient, the source, the purity, etc. and are provided as exemplary.

Exemplary Ingredient Densities:

| Ingredient | Density (g/mL) |
|---|---|
| Agave syrup | 0.93 |
| Almond oil | 0.91 |
| Ascorbic acid | 1.65 |
| Bamboo fiber | 0.974 |
| Beta-caryophyllene | 0.901 |
| Beta-pinene | 0.872 |
| Caffeine | 1.23 |
| Caryophyllene | 0.9052 |
| Cellulose fiber | 1.5 |
| Chocolate liquor | 0.57 |
| Citric acid | 1.542 |
| Cocoa extract | 1.29 |
| Corn syrup solids | 1.4 |
| Cis-nerolidol | 0.876 |
| D-limonene | 0.8411 |
| Maltodextrin | 1.5 |
| Hemp | 4853.44 |
| Molasses | 1.4 |
| Myrcene | 0.794 |
| Sodium | 0.968 |
| Soy lecithin | 1.03 |
| Sunflower lecithin | 1.03 |
| Water | 1 |

Below are tables of exemplary formulas of the snuff:

Example 1

| Ingredient | Low (g) | High (g) | Density (g/mL) | Low (ppm) | High (ppm) |
|---|---|---|---|---|---|
| Hemp | 500 | 500 | 4853.44 | 996770.46 | 876009.6 |
| Cotton fiber | 0.021 | 8.76 | 1.54 | 41.86 | 15347.69 |
| Water | 1.44 | 23.55 | 1 | 2870.7 | 41260.05 |
| Sodium | 0.013 | 16.44 | 0.97 | 25.92 | 28803.2 |
| Mold inhibitor | 0.01 | 5.87 | 0.79 | 19.94 | 10284.35 |
| Sunflower lecithin | 0.01 | 4.88 | 1.03 | 19.94 | 8549.85 |
| Ginger | 0.001 | 2.77 | 1 | 1.99 | 4853.09 |
| Malic/Citric acid | 0.11 | 3.01 | 1.54 | 219.29 | 5273.58 |
| Myrcene | 0.001 | 0.44 | 0.79 | 1.99 | 770.89 |
| Humulene | 0.001 | 0.88 | 0.89 | 1.99 | 1541.78 |
| Alpha pinene | 0.0124 | 2.98 | 0.86 | 24.72 | 5221.02 |
| Beta pinene | 0.001 | 0.66 | 0.87 | 1.99 | 1156.33 |
| Caryophyllene | 0.0088 | 0.53 | 0.91 | 17.54 | 928.57 |
| Total Mass | 501.6292 | 570.77 | | | |

Example 2

| Ingredient | Low (g) | High (g) | Density (g/mL) | PPM (Low) | PPM (High) |
|---|---|---|---|---|---|
| Hemp | 500 | 500 | 4853.44 | 994750.7 | 676178.24 |
| Cellulose fiber | 0.113 | 0.113 | 1.14 | 224.81 | 152.82 |
| Water | 1.111 | 211 | 1 | 2210.34 | 285347.22 |
| Sodium | 1.03 | 14.33 | 1.22 | 2049.19 | 19379.27 |
| Mold inhibitor | 0.12 | 0.77 | 0.79 | 238.74 | 1041.31 |
| Data esters (emulsifier) | 0.01 | 6.64 | 1.09 | 19.9 | 8979.65 |
| Licorice | 0.11 | 1.77 | 0.02 | 218.85 | 2393.67 |
| Caffeine | 0.01 | 1.99 | 1.23 | 19.9 | 2691.19 |
| Ascorbic acid | 0.11 | 0.77 | 0.33 | 218.85 | 1041.31 |
| Myrcene | 0.001 | 0.51 | 0.11 | 1.99 | 689.7 |
| Humulene | 0.0125 | 0.77 | 0.11 | 24.87 | 1041.31 |
| Alpha pinene | 0.01 | 0.127 | 0.11 | 19.9 | 171.75 |
| Caryophyllene | 0.001 | 0.66 | 0.1 | 1.99 | 892.56 |
| Total Mass | 502.6385 | 739.45 | | | |

Example 3

| Ingredient | Low (g) | High (g) | Density (g/mL) | PPM (Low) | PPM (High) |
|---|---|---|---|---|---|
| Hemp | 500 | 500 | 4853.44 | 959834.57 | 924703.26 |
| Bamboo fiber | 0.1 | 0.88 | 0.97 | 191.97 | 1627.48 |
| Water | 17 | 21 | 1 | 32634.38 | 38837.54 |
| Salt | 3.33 | 13.4 | 1.22 | 6392.5 | 24782.05 |
| Mold inhibitor | 0.11 | 0.77 | 0.79 | 211.16 | 1424.04 |
| Sucrose esters | 0.11 | 0.33 | 1.1 | 211.16 | 610.3 |
| Agave syrup | 0.11 | 0.93 | 0.93 | 211.16 | 1719.95 |
| Caffeine | 0.005 | 0.21 | 1.23 | 9.6 | 388.38 |
| Citric acid | 0.01 | 0.66 | 1.54 | 19.2 | 1220.61 |
| Cuparene | 0.0125 | 0.884 | 0.89 | 24 | 1634.88 |
| Farnesol | 0.11 | 0.67 | 0.89 | 211.16 | 1239.1 |
| Cis-nerolidol | 0.0125 | 0.88 | 0.88 | 24 | 1627.48 |
| Myrcene | 0.0131 | 0.1 | 0.79 | 25.15 | 184.94 |
| Total Mass | 520.9231 | 540.714 | | | |

Example 4

| Ingredient | Low (g) | High (g) | Density (g/mL) | PPM (Low) | PPM (High) |
|---|---|---|---|---|---|
| Hemp | 500 | 500 | 4853.44 | 986894.63 | 912941.86 |
| Bamboo fiber | 0.001 | 5.1 | 0.97 | 1.97 | 9312.01 |
| Water | 5 | 16.4 | 1 | 9868.95 | 29944.49 |
| Sodium | 1.3 | 11.88 | 1.22 | 2565.93 | 21691.5 |
| Mold inhibitor | 0.01 | 1.4 | 0.79 | 19.74 | 2556.24 |
| Soy lecithin | 0.1 | 1.72 | 1.03 | 197.38 | 3140.52 |
| Molasses | 0.1 | 1.44 | 1.4 | 197.38 | 2629.27 |
| Ginger | 0.05 | 0.88 | 1 | 98.69 | 1606.78 |
| Malic acid | 0.022 | 0.77 | 1.61 | 43.42 | 1405.93 |
| Citric acid | 0.002 | 0.77 | 1.54 | 3.95 | 1405.93 |
| Myrcene | 0.01 | 1.6 | 0.79 | 19.74 | 2921.41 |
| Humulene | 0.0125 | 1.3 | 0.89 | 24.67 | 2373.65 |
| Caryophyllene | 0.01 | 1.25 | 0.91 | 19.74 | 2282.35 |
| Alpha pinene | 0.0122 | 1.7 | 0.86 | 24.08 | 3104 |
| Beta pinene | 0.01 | 1.47 | 0.87 | 19.74 | 2684.05 |
| Total Mass | 506.6397 | 547.68 | | | |

Example 5

| Ingredient | Low (g) | High (g) | Density (g/mL) | PPM (Low) | PPM (High) |
|---|---|---|---|---|---|
| Hemp | 500 | 500 | 4853.44 | 986485.74 | 895094.88 |
| Bamboo fiber | 0.001 | 5.1 | 0.97 | 1.97 | 9129.97 |
| Water | 5 | 16.4 | 1 | 9864.86 | 29359.11 |
| Sodium | 1.3 | 11.88 | 1.22 | 2564.86 | 21267.45 |
| Mold inhibitor | 0.01 | 1.4 | 0.79 | 19.73 | 2506.27 |
| Soy lecithin | 0.1 | 1.72 | 1.03 | 197.3 | 3079.13 |
| Molasses | 0.1 | 1.44 | 1.4 | 197.3 | 2577.87 |
| Ginger | 0.05 | 0.88 | 1 | 98.65 | 1575.37 |
| Malic acid | 0.022 | 0.77 | 1.61 | 43.41 | 1378.45 |
| Citric acid | 0.002 | 0.77 | 1.54 | 3.95 | 1378.45 |
| Myrcene | 0.01 | 1.6 | 0.79 | 19.73 | 2864.3 |
| Humulene | 0.0125 | 1.3 | 0.89 | 24.66 | 2327.25 |
| Caryophyllene | 0.01 | 1.25 | 0.91 | 19.73 | 2237.74 |
| Alpha pinene | 0.0122 | 1.7 | 0.86 | 24.07 | 3043.32 |
| Beta pinene | 0.01 | 1.47 | 0.87 | 19.73 | 2631.58 |
| Beef extract | 0.11 | 8.7 | 1.03 | 217.03 | 15574.65 |
| Maltodextrin | 0.1 | 2.22 | 1.5 | 197.3 | 3974.22 |
| Total Mass | 506.8497 | 558.6 | | | |

Example 6

| Ingredient | Low (g) | High (g) | Density (g/mL) | PPM (Low) | PPM (High) |
|---|---|---|---|---|---|
| Hemp | 500 | 500 | 4853.44 | 986485.74 | 895094.88 |
| Bamboo fiber | 0.001 | 5.1 | 0.97 | 1.97 | 9129.97 |
| Water | 5 | 16.4 | 1 | 9864.86 | 29359.11 |
| Sodium | 1.3 | 11.88 | 1.22 | 2564.86 | 21267.45 |
| Mold inhibitor | 0.01 | 1.4 | 0.79 | 19.73 | 2506.27 |
| Soy lecithin | 0.1 | 1.72 | 1.03 | 197.3 | 3079.13 |
| Molasses | 0.1 | 1.44 | 1.4 | 197.3 | 2577.87 |
| Ginger | 0.05 | 0.88 | 1 | 98.65 | 1575.37 |
| Malic acid | 0.022 | 0.77 | 1.61 | 43.41 | 1378.45 |
| Citric acid | 0.002 | 0.77 | 1.54 | 3.95 | 1378.45 |
| Myrcene | 0.01 | 1.6 | 0.79 | 19.73 | 2864.3 |
| Humulene | 0.0125 | 1.3 | 0.89 | 24.66 | 2327.25 |
| Caryophyllene | 0.01 | 1.25 | 0.91 | 19.73 | 2237.74 |
| Alpha pinene | 0.0122 | 1.7 | 0.86 | 24.07 | 3043.32 |
| Beta pinene | 0.01 | 1.47 | 0.87 | 19.73 | 2631.58 |
| Strawberry extract | 0.11 | 8.7 | 1.05 | 217.03 | 15574.65 |
| Almond oil | 0.1 | 2.22 | 0.91 | 197.3 | 3974.22 |
| Total Mass | 506.8497 | 558.6 | | | |

Example 7

| Ingredient | Low (g) | High (g) | Density (g/mL) | PPM (Low) | PPM (High) |
|---|---|---|---|---|---|
| Hemp | 500 | 500 | 4853.44 | 986485.74 | 895094.88 |
| Bamboo fiber | 0.001 | 5.1 | 0.97 | 1.97 | 9129.97 |
| Water | 5 | 16.4 | 1 | 9864.86 | 29359.11 |
| Sodium | 1.3 | 11.88 | 1.22 | 2564.86 | 21267.45 |
| Mold inhibitor | 0.01 | 1.4 | 0.79 | 19.73 | 2506.27 |
| Soy lecithin | 0.1 | 1.72 | 1.03 | 197.3 | 3079.13 |
| Molasses | 0.1 | 1.44 | 1.4 | 197.3 | 2577.87 |
| Ginger | 0.05 | 0.88 | 1 | 98.65 | 1575.37 |
| Malic acid | 0.022 | 0.77 | 1.61 | 43.41 | 1378.45 |
| Citric acid | 0.002 | 0.77 | 1.54 | 3.95 | 1378.45 |
| Myrcene | 0.01 | 1.6 | 0.79 | 19.73 | 2864.3 |
| Humulene | 0.0125 | 1.3 | 0.89 | 24.66 | 2327.25 |
| Caryophyllene | 0.01 | 1.25 | 0.91 | 19.73 | 2237.74 |
| Alpha pinene | 0.0122 | 1.7 | 0.86 | 24.07 | 3043.32 |

-continued

| Ingredient | Low (g) | High (g) | Density (g/mL) | PPM (Low) | PPM (High) |
|---|---|---|---|---|---|
| Beta pinene | 0.01 | 1.47 | 0.87 | 19.73 | 2631.58 |
| Cocoa extract | 0.11 | 8.7 | 1.29 | 217.03 | 15574.65 |
| Menthe extract | 0.1 | 2.22 | 1.05 | 197.3 | 3974.22 |
| Total Mass | 506.8497 | 558.6 | | | |

Example 8

| Ingredient | Low (g) | High (g) | Density (g/mL) | PPM (Low) | PPM (High) |
|---|---|---|---|---|---|
| Hemp | 500 | 500 | 4853.44 | 985960.51 | 886461.95 |
| Bamboo fiber | 0.001 | 5.1 | 0.97 | 1.97 | 9041.91 |
| Water | 5 | 16.4 | 1 | 9859.61 | 29075.95 |
| Sodium | 1.3 | 11.88 | 1.22 | 2563.5 | 21062.34 |
| Mold inhibitor | 0.01 | 1.4 | 0.79 | 19.72 | 2482.09 |
| Soy lecithin | 0.1 | 1.72 | 1.03 | 197.19 | 3049.43 |
| Molasses | 0.1 | 1.44 | 1.4 | 197.19 | 2553.01 |
| Ginger | 0.05 | 0.88 | 1 | 98.6 | 1560.17 |
| Malic acid | 0.022 | 0.77 | 1.61 | 43.38 | 1365.15 |
| Citric acid | 0.002 | 0.77 | 1.54 | 3.94 | 1365.15 |
| Myrcene | 0.01 | 1.6 | 0.79 | 19.72 | 2836.68 |
| Humulene | 0.0125 | 1.3 | 0.89 | 24.65 | 2304.8 |
| Caryophyllene | 0.01 | 1.25 | 0.91 | 19.72 | 2216.15 |
| Alpha pinene | 0.0122 | 1.7 | 0.86 | 24.06 | 3013.97 |
| Beta pinene | 0.01 | 1.47 | 0.87 | 19.72 | 2606.2 |
| Sesame oil | 0.11 | 8.7 | 0.92 | 216.91 | 15424.44 |
| Ginger extract | 0.17 | 3.11 | 1.05 | 335.23 | 5513.79 |
| Onion | 0.1 | 2.22 | 1.05 | 197.19 | 3935.89 |
| Garlic | 0.1 | 2.33 | 1.05 | 197.19 | 4130.91 |
| Total Mass | 507.1197 | 564.04 | | | |

Example 9

| Ingredient | Low (g) | High (g) | Density (g/mL) | PPM (Low) | PPM (High) |
|---|---|---|---|---|---|
| Hemp | 500 | 500 | 4853.44 | 984820.57 | 878333.27 |
| Bamboo fiber | 0.001 | 5.1 | 0.97 | 1.97 | 8959 |
| Water | 5 | 16.4 | 1 | 9848.21 | 28809.33 |
| Sodium | 1.3 | 11.88 | 1.22 | 2560.53 | 20869.2 |
| Mold inhibitor | 0.01 | 1.4 | 0.79 | 19.7 | 2459.33 |
| Soy lecithin | 0.1 | 1.72 | 1.03 | 196.96 | 3021.47 |
| Molasses | 0.1 | 1.44 | 1.4 | 196.96 | 2529.6 |
| Ginger | 0.05 | 0.88 | 1 | 98.48 | 1545.87 |
| Malic acid | 0.022 | 0.77 | 1.61 | 43.33 | 1352.63 |
| Citric acid | 0.002 | 0.77 | 1.54 | 3.94 | 1352.63 |
| Myrcene | 0.01 | 1.6 | 0.79 | 19.7 | 2810.67 |
| Humulene | 0.0125 | 1.3 | 0.89 | 24.62 | 2283.67 |
| Caryophyllene | 0.01 | 1.25 | 0.91 | 19.7 | 2195.83 |
| Alpha pinene | 0.0122 | 1.7 | 0.86 | 24.03 | 2986.33 |
| Beta pinene | 0.01 | 1.47 | 0.87 | 19.7 | 2582.3 |
| Mesquite | 0.11 | 8.7 | 0.98 | 216.66 | 15283 |
| Soy sauce | 0.17 | 3.11 | 1.1 | 334.84 | 5463.23 |
| Garlic | 0.033 | 0.66 | 1.05 | 65 | 1159.4 |
| Smoke flavors | 0.104 | 2.66 | 1 | 204.84 | 4672.73 |
| Dextrose | 0.44 | 3.12 | 1.4 | 866.64 | 5480.8 |
| Turmeric | 0.21 | 3.33 | 1.37 | 413.62 | 5849.7 |
| Total Mass | 507.7067 | 569.26 | | | |

Example 10

| Ingredient | Low (g) | High (g) | Density (g/mL) | PPM (Low) | PPM (High) |
|---|---|---|---|---|---|
| Hemp | 500 | 500 | 4853.44 | 985247.5 | 882986.61 |
| Bamboo fiber | 0.001 | 5.1 | 0.97 | 1.97 | 9006.46 |
| Water | 5 | 16.4 | 1 | 9852.47 | 28961.96 |
| Sodium | 1.3 | 11.88 | 1.22 | 2561.64 | 20979.76 |
| Mold inhibitor | 0.01 | 1.4 | 0.79 | 19.7 | 2472.36 |
| Soy lecithin | 0.1 | 1.72 | 1.03 | 197.05 | 3037.47 |
| Molasses | 0.1 | 1.44 | 1.4 | 197.05 | 2543 |
| Ginger | 0.05 | 0.88 | 1 | 98.52 | 1554.06 |
| Malic acid | 0.022 | 0.77 | 1.61 | 43.35 | 1359.8 |
| Citric acid | 0.002 | 0.77 | 1.54 | 3.94 | 1359.8 |
| Myrcene | 0.01 | 1.6 | 0.79 | 19.7 | 2825.56 |
| Humulene | 0.0125 | 1.3 | 0.89 | 24.63 | 2295.77 |
| Caryophyllene | 0.01 | 1.25 | 0.91 | 19.7 | 2207.47 |
| Alpha pinene | 0.0122 | 1.7 | 0.86 | 24.04 | 3002.15 |
| Beta pinene | 0.01 | 1.47 | 0.87 | 19.7 | 2595.98 |
| Soy sauce solids | 0.11 | 8.7 | 1.1 | 216.75 | 15363.97 |
| Red pepper | 0.17 | 3.11 | 0.91 | 334.98 | 5492.18 |
| Vinegar | 0.033 | 0.66 | 1.01 | 65.03 | 1165.54 |
| Paprika oil | 0.104 | 2.66 | 0.92 | 204.93 | 4697.49 |
| Corn syrup solids | 0.22 | 2.12 | 1.4 | 433.51 | 3743.86 |
| Turmeric | 0.21 | 1.33 | 1.37 | 413.8 | 2348.74 |
| Total Mass | 507.4867 | 566.26 | | | |

Example 11

| Ingredient | Low (g) | High (g) | Density (g/mL) | PPM (Low) | PPM (High) |
|---|---|---|---|---|---|
| Hemp | 500 | 500 | 4853.44 | 986083.02 | 888399.28 |
| Bamboo fiber | 0 | 5.1 | 0.97 | 1.97 | 9061.67 |
| Water | 5 | 16.4 | 1 | 9860.83 | 29139.5 |
| Sodium | 1.3 | 11.88 | 1.22 | 2563.82 | 21108.37 |
| Mold inhibitor | 0.01 | 1.4 | 0.79 | 19.72 | 2487.52 |
| Soy lecithin | 0.1 | 1.72 | 1.03 | 197.22 | 3056.09 |
| Molasses | 0.1 | 1.44 | 1.4 | 197.22 | 2558.59 |
| Ginger | 0.05 | 0.88 | 1 | 98.61 | 1563.58 |
| Malic acid | 0.02 | 0.77 | 1.61 | 43.39 | 1368.13 |
| Citric acid | 0 | 0.77 | 1.54 | 3.94 | 1368.13 |
| Myrcene | 0.01 | 1.6 | 0.79 | 19.72 | 2842.88 |
| Humulene | 0.01 | 1.3 | 0.89 | 24.65 | 2309.84 |
| Caryophyllene | 0.01 | 1.25 | 0.91 | 19.72 | 2221 |
| Alpha pinene | 0.01 | 1.7 | 0.86 | 24.06 | 3020.56 |
| Linalool | 0.01 | 1.47 | 0.86 | 19.72 | 2611.89 |
| D-limonene | 0.11 | 8.7 | 0.84 | 216.94 | 15458.15 |
| Beta caryophyllene | 0.17 | 3.11 | 0.9 | 335.27 | 5525.84 |
| Alpha caryophyllene | 0.03 | 0.66 | 0.91 | 65.08 | 1172.69 |
| Valencene | 0.1 | 2.66 | 0.9 | 205.11 | 4726.28 |
| Total Mass | 507.04 | 562.81 | | | |

Example 12

| Ingredient | Low (g) | High (g) | Density (g/mL) | PPM (Low) | PPM (High) |
|---|---|---|---|---|---|
| Hemp | 500 | 500 | 4853.44 | 985888.58 | 888241.46 |
| Bamboo fiber | 0.001 | 5.1 | 0.97 | 1.97 | 9060.06 |
| Water | 5 | 16.4 | 1 | 9858.89 | 29134.32 |
| Sodium | 1.3 | 11.88 | 1.22 | 2563.31 | 21104.62 |
| Mold inhibitor | 0.01 | 1.4 | 0.79 | 19.72 | 2487.08 |
| Soy lecithin | 0.1 | 1.72 | 1.03 | 197.18 | 3055.55 |
| Molasses | 0.1 | 1.44 | 1.4 | 197.18 | 2558.14 |
| Ginger | 0.05 | 0.88 | 1 | 98.59 | 1563.3 |
| Malic acid | 0.022 | 0.77 | 1.61 | 43.38 | 1367.89 |
| Citric acid | 0.002 | 0.77 | 1.54 | 3.94 | 1367.89 |
| Myrcene | 0.01 | 1.6 | 0.79 | 19.72 | 2842.37 |
| Humulene | 0.0125 | 1.3 | 0.89 | 24.65 | 2309.43 |

-continued

| Ingredient | Low (g) | High (g) | Density (g/mL) | PPM (Low) | PPM (High) |
|---|---|---|---|---|---|
| Caryophyllene | 0.01 | 1.25 | 0.91 | 19.72 | 2220.6 |
| Alpha pinene | 0.0122 | 1.7 | 0.86 | 24.06 | 3020.02 |
| Linalool | 0.01 | 1.47 | 0.86 | 19.72 | 2611.43 |
| Picrocrocin | 0.11 | 8.7 | 1.19 | 216.9 | 15455.4 |
| Beta caryophyllene | 0.17 | 3.11 | 0.9 | 335.2 | 5524.86 |
| Alpha caryophyllene | 0.033 | 0.66 | 0.91 | 65.07 | 1172.48 |
| Valencene | 0.104 | 2.66 | 0.9 | 205.06 | 4725.44 |
| Safrene | 0.1 | 0.1 | 0.94 | 197.18 | 177.65 |
| Total Mass | 507.1567 | 562.91 | | | |

15

Example 13

| Ingredient | Low (g) | High (g) | Density (g/mL) | PPM (Low) | PPM (High) |
|---|---|---|---|---|---|
| Hemp | 470 | 496 | 4853.44 | 681496.22 | 646498.35 |
| Water | 218 | 247.8 | 1 | 316098.25 | 322988.49 |
| Bamboo fiber | 0.01 | 5.67 | 0.97 | 14.5 | 7390.41 |
| Myrcene | 0.01 | 0.44 | 0.79 | 14.5 | 573.51 |
| Humulene | 0.001 | 0.88 | 0.89 | 1.45 | 1147.01 |
| Alpha-Pinene | 0.124 | 0.66 | 0.86 | 179.8 | 860.26 |
| Beta-Caryophyllene | 0.088 | 0.53 | 0.9 | 127.6 | 690.81 |
| Mold inhibitor | 0.11 | 0.93 | 0.79 | 159.5 | 1212.18 |
| Sodium | 1.3 | 11.88 | 1.22 | 1884.99 | 15484.68 |
| Beef extract | 0.013 | 1.755 | 1.03 | 18.85 | 2287.51 |
| Emulsifier (Polysorbate 80) | 0.003 | 0.665 | 1.09 | 4.35 | 866.78 |
| Total Mass | 689.659 | 767.21 | | | |

Example 14

| Ingredient | Low (g) | High (g) | Density (g/mL) | PPM (Low) | PPM (High) |
|---|---|---|---|---|---|
| Hemp | 483 | 488 | 4853.44 | 686863.98 | 629539.33 |
| Water | 218 | 247.8 | 1 | 310013.14 | 319671.81 |
| Bamboo fiber | 0.01 | 5.67 | 0.97 | 14.22 | 7314.52 |
| Myrcene | 0.01 | 0.44 | 0.79 | 14.22 | 567.62 |
| Humulene | 0.001 | 0.88 | 0.89 | 1.42 | 1135.23 |
| Alpha-Pinene | 0.124 | 0.66 | 0.86 | 176.34 | 851.43 |
| Beta-Caryophyllene | 0.088 | 0.53 | 0.9 | 125.14 | 683.72 |
| Mold inhibitor | 0.11 | 0.93 | 0.79 | 156.43 | 1199.74 |
| Sodium | 1.3 | 11.88 | 1.22 | 1848.7 | 15325.67 |
| Chocolate liquor | 0.55 | 10.61 | 0.57 | 782.14 | 13687.32 |
| Lemongrass oil | 0.001 | 3.11 | 0.91 | 1.42 | 4012.02 |
| Emulsifier (Polysorbate 60) | 0.001 | 2.66 | 1.06 | 1.42 | 3431.51 |
| Mono-diglyceride | 0.001 | 2 | 0.95 | 1.42 | 2580.08 |
| Total Mass | 703.196 | 775.17 | | | |

Example 15

| Ingredient | Low (g) | High (g) | Density (g/mL) | PPM (Low) | PPM (High) |
|---|---|---|---|---|---|
| Hemp | 494 | 514 | 4853.44 | 691558.09 | 630431.18 |
| Water | 218 | 247.8 | 1 | 305181.51 | 303931.61 |
| Bamboo fiber | 0.01 | 5.67 | 0.97 | 14 | 6954.37 |
| Myrcene | 0.01 | 0.44 | 0.79 | 14 | 539.67 |
| Humulene | 0.001 | 0.88 | 0.89 | 1.4 | 1079.34 |
| Alpha-Pinene | 0.124 | 0.66 | 0.86 | 173.59 | 809.5 |
| Beta-Caryophyllene | 0.088 | 0.53 | 0.9 | 123.19 | 650.06 |
| Mold inhibitor | 0.11 | 0.93 | 0.79 | 153.99 | 1140.66 |

-continued

| Ingredient | Low (g) | High (g) | Density (g/mL) | PPM (Low) | PPM (High) |
|---|---|---|---|---|---|
| Sodium | 1.3 | 11.88 | 1.22 | 1819.89 | 14571.06 |
| Chocolate liquor | 0.55 | 10.61 | 0.57 | 769.95 | 13013.38 |
| Ethyl alcohol | 0.013 | 10.1 | 0.79 | 18.2 | 12387.85 |
| Peppermint oil | 0.01 | 4.6 | 0.9 | 14 | 5641.99 |
| Spearmint oil | 0.11 | 3.55 | 0.92 | 153.99 | 4354.15 |
| Emulsifier (Polysorbate 80) | 0.003 | 3.665 | 1.09 | 4.2 | 4495.2 |
| Total Mass | 714.329 | 815.315 | | | |

Example 16

| Ingredient | Low (g) | High (g) | Density (g/mL) | PPM (Low) | PPM (High) |
|---|---|---|---|---|---|
| Hemp | 488 | 505 | 4853.44 | 688957.06 | 633886.97 |
| Water | 218 | 247.8 | 1 | 307771.8 | 311043.94 |
| Bamboo fiber | 0.01 | 5.67 | 0.97 | 14.12 | 7117.11 |
| Myrcene | 0.01 | 0.44 | 0.79 | 14.12 | 552.3 |
| Humulene | 0.001 | 0.88 | 0.89 | 1.41 | 1104.6 |
| Alpha-Pinene | 0.124 | 0.66 | 0.86 | 175.06 | 828.45 |
| Beta-Caryophyllene | 0.088 | 0.53 | 0.9 | 124.24 | 665.27 |
| Mold inhibitor | 0.11 | 0.93 | 0.79 | 155.3 | 1167.36 |
| Sodium | 1.3 | 11.88 | 1.22 | 1835.34 | 14912.03 |
| Chocolate liquor | 0.55 | 10.61 | 0.57 | 776.49 | 13317.9 |
| Strawberry extract | 0.12 | 8.44 | 1.05 | 169.42 | 10594.07 |
| Emulsifier (Polysorbate 80) | 0.003 | 3.665 | 1.09 | 4.24 | 4600.39 |
| Mono-diglyceride | 0.001 | 0.167 | 0.95 | 1.41 | 209.62 |
| Total Mass | 708.317 | 796.672 | | | |

Example 17

| Ingredient | Low (g) | High (g) | Density (g/mL) | PPM (Low) | PPM (High) |
|---|---|---|---|---|---|
| Hemp | 503 | 566 | 4853.44 | 695408.37 | 660994.88 |
| Water | 218 | 247.8 | 1 | 301389.71 | 289389.63 |
| Bamboo fiber | 0.01 | 5.67 | 0.97 | 13.83 | 6621.63 |
| Myrcene | 0.01 | 0.44 | 0.79 | 13.83 | 513.85 |
| Humulene | 0.001 | 0.88 | 0.89 | 1.38 | 1027.7 |
| Alpha-Pinene | 0.124 | 0.66 | 0.86 | 171.43 | 770.77 |
| Beta-Caryophyllene | 0.088 | 0.53 | 0.9 | 121.66 | 618.95 |
| Mold inhibitor | 0.11 | 0.93 | 0.79 | 152.08 | 1086.09 |
| Sodium | 1.3 | 11.88 | 1.22 | 1797.28 | 13873.89 |
| Chocolate liquor | 0.55 | 10.61 | 0.57 | 760.39 | 12390.73 |
| Emulsifier (Succinated esters) | 0.003 | 3.665 | 1.06 | 4.15 | 4280.12 |
| Almond oil | 0.12 | 7.22 | 0.91 | 165.9 | 8431.77 |
| Total Mass | 723.316 | 856.285 | | | |

Example 18

| Ingredient | Low (g) | High (g) | Density (g/mL) | PPM (Low) | PPM (High) |
|---|---|---|---|---|---|
| Hemp | 505 | 577 | 4853.44 | 696907.39 | 676371.09 |
| Water | 218 | 247.8 | 1 | 300843.19 | 290476.18 |
| Bamboo fiber | 0.01 | 5.67 | 0.97 | 13.8 | 6646.49 |
| Myrcene | 0.01 | 0.61 | 0.79 | 13.8 | 715.05 |
| Humulene | 0.001 | 0.155 | 0.89 | 1.38 | 181.69 |
| Alpha-Pinene | 0.124 | 0.012 | 0.86 | 171.12 | 14.07 |
| Beta-Caryophyllene | 0.001 | 0.66 | 0.9 | 1.38 | 773.67 |
| Mold inhibitor | 0.011 | 0.2 | 0.79 | 15.18 | 234.44 |
| Sodium | 1.3 | 11.88 | 1.22 | 1794.02 | 13925.98 |

-continued

| Ingredient | Low (g) | High (g) | Density (g/mL) | PPM (Low) | PPM (High) |
|---|---|---|---|---|---|
| Emulsifier (Polysorbate 80) | 0.003 | 3.665 | 1.09 | 4.14 | 4296.19 |
| Sorbitan esters | 0.17 | 5.43 | 1.05 | 234.6 | 6365.16 |
| Total Mass | 724.63 | 853.082 | | | |

Example 19

| Ingredient | Percent | g/mL | PPM |
|---|---|---|---|
| Hemp (Sativa/Indica) | 53.77 | 4853.44 | 4858984 |
| Sodium | 4.88 | 45876.45 | 45876.45 |
| Lecithin | 3.63 | 340.8 | 341189.3 |
| Glycerol | 3.63 | 340.8 | 341189.3 |
| Molasses | 3.63 | 340.8 | 341189.3 |
| Oligosaccharide | 3.63 | 340.8 | 341189.3 |
| Cellulose Fiber | 1.45 | 136.1 | 136255.47 |
| Malic Acid | 1.21 | 113.9 | 114030.12 |
| Citric Acid | 1.11 | 104.89 | 75215.52 |
| Cyclodextrin | 0.01 | 0.5 | 500.57 |
| Hydrocolloid | 0.01 | 1 | 1001.14 |
| Enzyme Inhibitor | 0.9 | 85.2 | 85297.33 |
| Alpha Pinene | 0.11 | 0.11 | 1101.56 |
| Myrcene | 0.11 | 0.11 | 1101.56 |
| Caryophyllene | 0.1 | 0.1 | 1101.56 |
| Humulene | 0.11 | 0.11 | 1101.56 |
| Beta Pinene | 0.15 | 14.7 | 14716.79 |
| Nutmeg | 0.15 | 14.7 | 14716.79 |
| Natural color | 0.15 | 14.7 | 14716.79 |

Example 20

| Ingredient | Min PPM | Max PPM |
|---|---|---|
| Bamboo fiber | 1.97 | 9312.01 |
| Myrcene | 1.99 | 2921.41 |

-continued

| Ingredient | Min PPM | Max PPM |
|---|---|---|
| Humulene | 1.38 | 2373.65 |
| Beta-Caryophyllene | 1.38 | 2282.35 |
| Mold inhibitor | 15.18 | 2556.24 |
| Alpha-Pinene | 14.07 | 5221.02 |
| Sodium | 1794.02 | 28803.2 |
| Water | 2210.34 | 322988.49 |
| Hemp | 629539.33 | 996770.46 |
| Beta pinene | 1.99 | 2684.05 |

Example 21

| Ingredient | Min PPM | Max PPM |
|---|---|---|
| Bamboo fiber | 1.97 | 9312.01 |
| Myrcene | 1.99 | 2921.41 |
| Humulene | 1.38 | 2373.65 |
| Beta-Caryophyllene | 1.38 | 2282.35 |
| Mold inhibitor | 15.18 | 2556.24 |
| Alpha-Pinene | 14.07 | 5221.02 |
| Sodium | 1794.02 | 28803.2 |
| Water | 2210.34 | 322988.49 |
| Hemp | 629539.33 | 996770.46 |

Exemplary Ranges of Common Ingredients:

| Ingredient | Percent (Low) | Percent (High) | PPM (Low) | PPM (High) |
|---|---|---|---|---|
| Hemp Sativa Biomass | <50% | >90% | <6000000 | >20000000 |
| Sodium Chloride | <1% | >8% | <20000 | >600000 |
| Sugar Alcohol | <1% | >7% | <10 | >35 |
| Soy Lecithin | <1.1% | >6.0% | <20000000 | >60000000 |
| Oligosaccharide | <1.0% | >8% | <20000000 | >60000000 |
| Cellulose Fiber | <0.1% | >5.0% | <1000000 | >15000000 |
| Malic Acid | <0.1% | >5.9% | 10000000 | >150000000 |
| Citric Acid | 0.10% | 5.00% | <1000000 | >5.0 |
| Gensing | <0.01% | >3.65% | <3000000 | >800000 |
| Cyclodextrin | <0.001% | >1.25% | <5000 | >1550 |
| Gum Arabic | <0.0001% | >0.10% | <5000 | >1500 |
| Mold Inhibitor | <1.0% | >4.0% | <300000 | >950000 |
| Natural Color | <0.01% | >4.0% | 0.1 | >2.3300 |
| Alpha Pinene | <0.01% | >0.68% | <10000 | >16000 |
| Myrcene | <0.01% | 0.71% | <10000 | >1650 |
| Caryophyllene | <0.01% | 0.71% | <100000 | >16000 |
| Humulene | <0.01% | >0.68% | <10000 | >1650 |

In some embodiments, the snuff may include ingredients selected from exemplary general categories such as (i) plant-based ingredients and extracts, (ii) essential oils & terpenes, (iii) essential oils & terpenes, (iv) salts, acids & seasonings, (v) emulsifiers & stabilizers, (vi) sweeteners & sugars, and (vii) bioactives and supplements. These listed ingredients are intended to provide examples, as one having the ordinary skill in the art will appreciate that similar ingredients, including the ingredients listed elsewhere in the specification, may be included in the snuff to develop flavor profiles.

Exemplary plant-based ingredients and extracts may include soy lecithin, soy sauce, soy sauce solids, spearmint oil, strawberry extract, sunflower lecithin, turmeric, vinegar, water, and the like.

Exemplary essential oils and terpenes may include alpha-pinene, beta-pinene, caryophyllene, beta-caryophyllene, alpha-caryophyllene, myrcene, humulene, linalool, d-limonene, cuparene, farnesol, valencene, cis-nerolidol, safrene, and the like.

Exemplary salts, acids and seasonings may include citric acid, malic acid, salt, sodium, red pepper, garlic, smoke flavors, and the like.

Exemplary emulsifiers and stabilizers may include data esters (emulsifier), emulsifier (polysorbate 60) emulsifier (polysorbate 80), emulsifier (succinated esters), monodiglyceride, sorbitan esters, maltodextrin, and the like.

Exemplary sweeteners and sugars may include dextrose, corn syrup solids, sucrose esters, and the like.

Exemplary bioactives and supplements may include ascorbic acid, caffeine, picrocrocin, and the like.

Carrier agents are ingredients that help deliver or stabilize active compounds, such as flavors, active botanicals, oils in a formulation, which typically aid in dispersing, emulsifying, or binding components together without being active themselves. Here, exemplary ingredients that may function as carrier agents include water (universal solvent and dispersing medium), cellulose fiber (acts as a bulking agent and stabilizer), sodium (may act as a stabilizer or preservative in small quantities), mold inhibitor (functional carrier to preserve the formula), data esters/emulsifier/sorbitan esters/similar emulsifier (used to blend oil and water phases), ascorbic acid (often doubles as an antioxidant and can stabilize other compounds), and licorice extract (may include glycyrrhizin)(as a base or carrier substance).

In some embodiments, one or more flavoring agents selected from the group consisting of ginger extract, cocoa extract, molasses, menthe extract, spearmint oil, peppermint oil, onion extract, garlic extract, turmeric, vinegar, and paprika oil.

In some embodiments, the flavoring profile is enhanced through the inclusion of essential oils derived from ginger or pinene-rich botanicals.

In some embodiments, the flavoring agents are present in a combined concentration of approximately 100 ppm to 15,575 ppm.

In some embodiments, the mold inhibitor comprises potassium sorbate, sodium benzoate, natamycin, or a combination thereof.

In some embodiments, the formulation is configured as a non-tobacco snuff product for buccal or nasal delivery.

In some embodiments, the emulsifier comprises polysorbate 80, succinated esters, or sorbitan esters.

In some embodiments, the binder comprises maltodextrin, mono- and diglycerides, bamboo, or cellulose derivatives.

In some embodiments, the stabilizer is selected from the group consisting of lecithin, glycerol, or hydrocolloids.

In some embodiments, the carrier agents are present in a combined concentration between approximately 200 ppm and 6,365 ppm.

In some embodiments, the carrier agents enhance uniform dispersion of flavor and active compounds in the final product.

In some embodiments, the formulation comprises antioxidant agents to preserve the integrity of volatile terpenes selected from the group consisting of alpha-pinene, myrcene, humulene, beta-caryophyllene, and beta-pinene.

In some embodiments, the antioxidant agent is ascorbic acid or tocopherol, present at a concentration between approximately 200 ppm and 2,500 ppm.

In some embodiments, terpene degradation is reduced by encapsulating volatile components within a protective carrier matrix comprising lecithin, cyclodextrins, or maltodextrin.

In some embodiments, moisture-regulating agents are selected from the group consisting of glycerol, cellulose fibers, or oligosaccharides.

In some embodiments, the moisture content is maintained between 8% and 15% by weight to optimize shelf stability and consumer mouthfeel.

In some embodiments, the water activity is adjusted through the inclusion of hygroscopic excipients, selected from salts and polyols.

In some embodiments, the active flavor or terpene components are embedded in a controlled-release matrix.

In some embodiments, the controlled-release matrix comprises crosslinked polysaccharides or biodegradable hydrocolloids.

In some embodiments, release of the flavor or bioactive agents is triggered by oral mucosa pH or enzymatic interaction during buccal or nasal administration.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A snuff comprising:

53.77% Hemp;

4.88% Sodium;

3.63% Lecithin;

3.63% Glycerol;

3.63% Molasses;

3.63% Oligosaccharide;
1.45% Cellulose Fiber;
1.21% Malic Acid;
1.11% Citric Acid;
0.01% Cyclodextrin;
0.01% Hydrocolloid;
0.9% Enzyme Inhibitor;
0.11% Alpha Pinene;
0.11% Myrcene;
0.1% Caryophyllene;
0.11% Humulene;
0.15% Beta Pinene;
0.15% Nutmeg;
0.15% Natural color;
between 8% and 15% by weight water; and Mold Inhibitor, wherein all percentages are expressed in percent by weight.

2. The composition of claim 1, further comprising one or more flavoring agents selected from the group consisting of ginger extract, cocoa extract, menthe extract, spearmint oil, peppermint oil, onion extract, garlic extract, turmeric, vinegar, and paprika oil.

3. The composition of claim 1, wherein said cellulose fiber is derived from bamboo, cotton, or corn.

4. The composition of claim 1, wherein the mold inhibitor comprises potassium sorbate, sodium benzoate, natamycin, or a combination thereof.

* * * * *